United States Patent [19]

Shiba et al.

[11] 4,163,670

[45] Aug. 7, 1979

[54] COLOR PHOTOGRAPHIC MATERIAL

[75] Inventors: Keisuke Shiba; Takeshi Hirose; Atsuaki Arai; Akio Okumura; Yukio Yokota, all of Minami-ashigara, Japan

[73] Assignee: Fuji Photo Film Co., Ltd., Minami-ashigara, Japan

[21] Appl. No.: 462,842

[22] Filed: Apr. 22, 1974

[30] Foreign Application Priority Data

Apr. 21, 1973 [JP] Japan ..... 48/45971

[51] Int. Cl.[2] ..... G03C 1/76; G03C 1/40

[52] U.S. Cl. ..... 96/74; 96/9; 96/56.1; 96/56.5; 96/99; 96/100 R

[58] Field of Search ..... 96/100, 74, 9, 99

[56] References Cited

U.S. PATENT DOCUMENTS

| | | | |
|---|---|---|---|
| 3,127,269 | 3/1964 | Greenhalgh et al. | 96/100 |
| 3,476,564 | 11/1969 | Mariani et al. | 96/9 |
| 3,576,635 | 4/1971 | Sakamoto et al. | 96/100 |
| 3,790,379 | 2/1974 | Oishi et al. | 96/100 |
| 4,070,191 | 1/1978 | Imamura et al. | 96/56.5 |

*Primary Examiner*—J. Travis Brown

*Attorney, Agent, or Firm*—Sughrue, Rothwell, Mion, Zinn and Macpeak

[57] ABSTRACT

A color photographic material having on a support at least a photographic emulsion containing an excellent colored coupler represented by the general formula wherein $R_1$ represents an aryl group or a heterocyclic group; $R_2$ represents a phenyl group having a halogen atom, an alkoxy group, or an aryloxy group at the ortho-position to the imino group bonded to the 3-position of the pyrazolone ring of the coupler; and $R_3$ represents a phenyl group having a hydroxyl group at the para-position to the azo group of the coupler; the coupler having a hydrophobic diffusion-resisting group in the molecule thereof.

11 Claims, 9 Drawing Figures

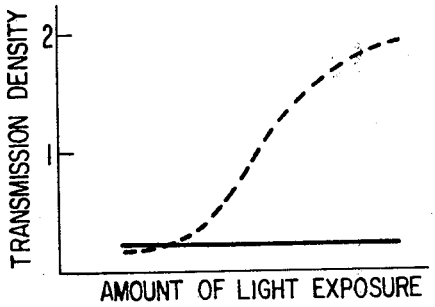
FIG. 6
FIG. 7
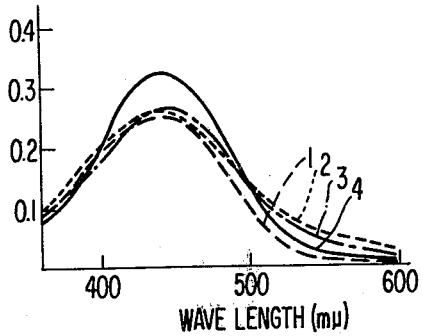
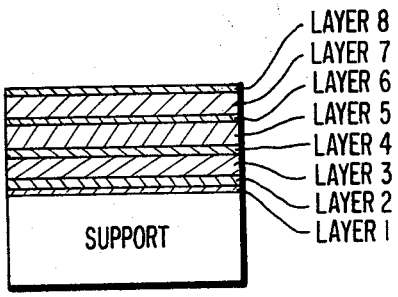
FIG. 8
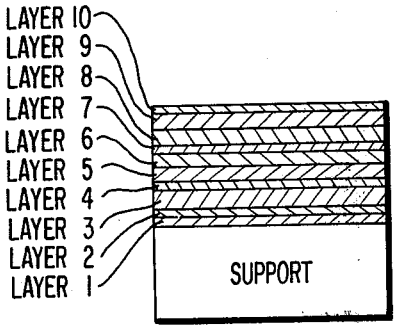
FIG. 9

COLOR PHOTOGRAPHIC MATERIAL

BACKGROUND OF THE INVENTION

1. Field of the Invention:

The present invention relates generally to color photography and particularly to a color photographic material containing a novel colored coupler in a photographic emulsion layer thereof.

2. Description of the Prior Art:

It is well known that the so-called couplers, that is to say, compounds capable of forming dyes such as indophenols, indoanilines, indamines, azomethines, phenoxazines, phenazines, etc., by a coupling reaction with oxidized primary aromatic amine developing agents are used in color photographic materials containing silver halide emulsion layers.

On the other hand, a silver halide color photographic material based on the subtractive three primary color principle has, as a layer structure, a silver halide emulsion layer to form a yellow color by the action of blue light, a silver halide emulsion layer to form a magenta color by the action of green light, and a silver halide emulsion layer to form a cyan color by the action of red light. When a color forming system wherein a primary aromatic amine developing agent and couplers are used is applied for color image formation of such a color photographic material, an acylacetamide derivative or a dibenzoylmethane derivative is usually used as the yellow forming coupler, a 5-pyrazolone derivative, a cyanoacetyl derivative, an indazolone derivative, or a pyrazolonebenzimidazole derivative is usually used as the magenta forming coupler, and a phenol derivative or an α-naphthol derivative is usually used as the cyan forming coupler.

In a color photographic material based on the subtractive three primary color principle, it is ideal that the yellow forming image absorbs blue light only, the magenta forming image absorbs green light only, and the cyan forming image absorbs red light only. However, the color images obtained in silver halide color photography using the above-described couplers are not always ideal and the color forming images usually have secondary absorptions and frequently absorb undesired light. It is known to use a so-called masking method employing colored couplers for correcting the secondary absorption deficiency of the color forming images as described in, e.g., *PSA Journal*, Vol. 13, 94(1947).

The color image formed by using a 5-pyrazolone derivative as a magenta-forming coupler has a secondary absorption in a blue region at about 440 nm in addition to the main absorption in a green region at about 550 nm. It is also well known to use a 5-pyrazolone having an arylazo group at the 4-position as a yellow colored coupler for correcting the secondary absorption color deficiency.

It is desired that the colored coupler used for the aforesaid masking system has sufficient light absorption characteristics for correcting the secondary absorption deficiency of the color forming images as well as sufficient development activity.

In the specifications of U.S. Pat. Nos. 2,428,054 and 2,449,966 a 1-phenyl-3-acylamino-4-phenylazo-5-pyrazolone is described as a colored coupler but a colored coupler of this type has a low development activity and hence in order to obtain sufficient masking using such a colored coupler, a large amount of the colored coupler is required, which results in reducing the sensitivity of the color photographic material containing the coupler.

Also, in the specification of U.S. Pat. No. 2,983,608 a 1-phenyl-3-anilino-5-phenylazo-5-pyrazolone is described as a colored coupler but although this colored coupler has a high development activity as compared to that of the above-described 3-acylamino type coupler, the colored coupler has a broad light absorption spectra and has a large undesired absorption of green light.

British Pat. No. 1,044,778 discloses a 1-phenyl-3-(2-halogenoanilino)-4-phenylazo-5-pyrazolone but this coupler has difficulties in that the coupler has a water-solubilizing group in the molecule and thus the treatment of such a coupler in the case of producing color photographic materials is troublesome and in that the coupler has a broad light absorption spectra and has a large undesired absorption in a green region.

Furthermore, in the specification of U.S. Pat. No. 3,615,506 the colored coupler having the following formula

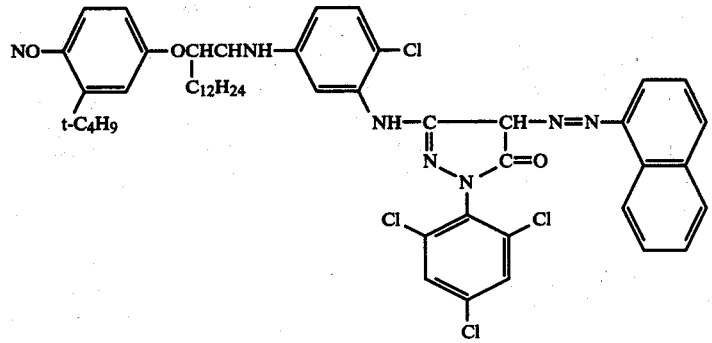

is described.

This coupler is, however, insufficient in development activity and also exhibits a large undesired absorption in a green region in the light absorption spectra thereof. Furthermore, α-naphthylamine is used as a raw material for preparing the coupler but the raw material contains β-naphthylamine which is a carcinogenic substance and thus such a material possesses handling difficulties from the view point of health.

As described above, pyrazolone type colored couplers which have hitherto been known have various specific difficulties in addition to low development activity as a common difficulty. The development activity of the colored coupler contributes greatly to the development speed of photographic emulsion layers containing the colored coupler and thus sufficient development speed cannot be obtained using such a conventional 5-pyrazolone type colored coupler. This difficulty is a large obstacle in shortening the development period for color photographic materials.

SUMMARY OF THE INVENTION

A first object of this invention is to provide a color photographic material containing a novel colored coupler capable of providing a sufficient color correction effect with a low masking density and having excellent spectral absorption characteristics.

A second object of this invention is to provide a color photographic material containing a novel colored coupler which has a high development activity and thus provides sufficient coupling density even in a shorter period of development.

A third object of this invention is to provide a novel colored coupler which can form a colored dye having excellent absorption characteristics and excellent fastness.

A fourth object of this invention is to provide a method of using a novel colored coupler capable of providing a high color correction effect on color development at a high temperature, e.g., at a temperature of higher than about 30° C. without adversely influencing the photographic properties, such as, for instance, formation of fog, desensitization, etc.

A fifth object of this invention is to provide a novel colored coupler which does not cause coating difficulties due to a viscosity change of photographic emulsions containing it with the passage of time, a coagulation of the coupler, etc., in the course of producing color photographic materials.

A sixth object of this invention is to provide a novel colored coupler which is prepared by a novel method using an intermediate product having no harmful physiological action.

The above and other objects of this invention will become apparent from the following descriptions.

That is to say, the aforesaid objects of this invention can be attained by employing a colored coupler having the following general formula (I) in color photographic materials:

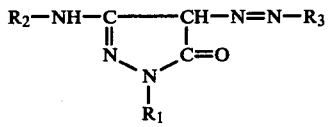

(I)

wherein $R_1$ represents an aryl group or a heterocyclic group; $R_2$ represents a phenyl group having a halogen atom, an alkoxy group, or an aryloxy group at the ortho-position to the imino group bonded to the 3-position of the pyrazolone ring of the coupler; and $R_3$ represents a phenyl group having a hydroxyl group at the para-position to the azo group of the coupler; the coupler having a hydrophobic diffusion resisting group in the molecule thereof.

Thus, according to the present invention a color photographic material comprising a support having coated thereon at least a silver halide photographic emulsion layer containing the colored coupler represented by the aforesaid general formula (I) is provided.

BRIEF DESCRIPTION OF THE ACCOMPANYING DRAWINGS

FIGS. 1 to 7 are spectrograms of photographic elements prepared in the Examples. FIGS. 8 and 9 are layer structures used in photographic element samples used in the Examples.

DETAILED DESCRIPTION OF THE INVENTION

Figure 1:
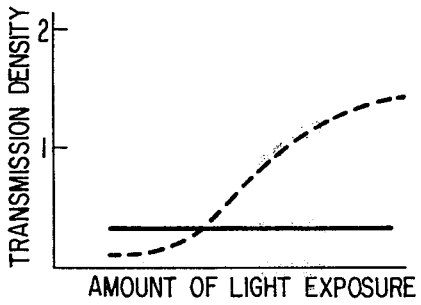

As described above, $R_1$ of the general formula (I) represents an aryl group or a heterocyclic group which can be substituted with halogen atoms and cyano, nitro, alkyl, alkoxy, aryl, aryloxy, amido, carbamoyl, sulfonamido, sulfamoyl, amino, acyl, acyloxy, alkylthio, etc. groups. Examples of suitable aryl groups include a phenyl group, a 2-chlorophenyl group, a 4-chlorophenyl group, a 2,5-dichlorophenyl group, a 2,6-dichlorophenyl group, a 2,4,6-trichlorophenyl group, a 2-bromophenyl group, a 3,5-dibromophenyl group, a 2-cyanophenyl group, a 4-cyanophenyl group, a 3-nitrophenyl group, a 4-nitrophenyl group, a 4-tolyl group, a 2,6-dimethylphenyl group, a 2,6-diethylphenyl group, a 4-butylphenyl group, a 2-trifluoromethylphenyl group, a 2-ethoxyphenyl group, a 4-phenylphenyl group, a 4-phenoxyphenyl group, a N-methyl-benzamidophenyl group, a N,N-diphenylcarbamylphenyl group, a N,N-diphenylsulfamylphenyl group, a N,N-dibutylsulfamylphenyl group, a phenyl-N-methyl-sulfonamidophenyl group, a 2-methyl-5-nitrophenyl group, a 2-chloro-5-cyanophenyl group, a 5-chloro-2-methylphenyl group, a 2,6-dichloro-4-methylphenyl group, a 2,4-dichloro-6-methylphenyl group, a 2-chloro-4,6-dimethylphenyl group, a 2,6-dichloro-4-methoxyphenyl group, a 2,6-dichloro-4-nitrophenyl group, a 2,4,6-trimethyl-3-nitrophenyl group, a 2,4,6-trimethyl-3-substituted aminophenyl group, a 2,6-dichloro-4-acetylphenyl group, a 4-hexadecylcarbonyloxyphenyl group, a 2,6-dichloro-4-amylthiophenyl group, etc. Also, suitable examples of heterocyclic groups include 5- and 6-membered heterocyclic rings such as a 2-thiazolyl ring, a 2-benzothiazolyl ring, a 2-benzoxazolyl ring, a 2-oxazolyl ring, a 2-imidazolyl ring, a 2-benzimidazolyl ring, etc.

$R_2$ represents a phenyl group having a halogen atom, an alkoxy group, or an aryloxy group at the ortho-position to the imino group bonded to the 3-position of the pyrazolone ring and $R_3$ represents a phenyl group having a hydroxyl group at the para-position to the azo group of the coupler. Each of groups $R_2$ and $R_3$ may further be substituted with an alkyl group (such as a methyl group, a tert-butyl group, an octyl group, a dodecyl group, etc.); an aryl group (such as a phenyl group, a tolyl group, etc.); an alkoxy group (such as a methoxy group, an octoxy group); an aryloxy group (such as a phenoxy group, a p-tert-butylphenoxy group, an naphthoxy group, etc. ); an alkylthio group (such as a methylthio group, an octylthio group, etc.); an arylthio group (such as a phenylthio group, etc.); an amino group (such as an amino group, a methylamino group, a diethylamino group, an anilino group, etc.); an amido group (such as an acetamido group, a butylamido group, a methylsulfonamido group, a diacylamido group, etc.); a sulfamoyl group (such as an N-sulfamoyl group, an N,N-diethylsulfamoyl group, an N-dodecylsulfamoyl group, an N-benzimidazolylsulfamoyl group, etc.); a carbamoyl group (such as a diethylcarbamoyl group, a tert-butylcarbamoyl group, an n-tetradecylcarbamoyl group, etc.); an alkoxycarbonyl group (such as a methoxycarbonyl group, a nonyloxycarbonyl group, a cyclohexyloxycarbonyl group, etc.); a halogen atom (such as a fluorine atom, a chlorine atom, a bromine atom, etc.); a hydroxyl group; a cyano group; or a nitro group. It is desired that the colored coupler represented by general formula (I) has at least one hydrophobic group having about 8 to 32 carbon atoms as a ballast group in the molecule thereof. The hydrophobic group facilitates the dissolution of the coupler in an organic solvent making it easy to disperse the coupler in a hydrophilic colloid and preventing the coupler from being crystallized to stabilize the color photographic material containing the colored coupler. If the number of carbon atoms of the hydrophobic group is less than about 8, the colored coupler is easily dissolved in a processing solution such as a developer and diffuses in photographic emulsion layers of the color photographic material, whereby the color reproduction is disturbed, while if the number of carbon atoms is larger than about 32, the interaction between coupler molecules becomes large and the coupler becomes only slightly soluble in organic solvents, which makes the use of such a colored coupler disadvantageous.

Examples of such a hydrophobic group having about 8 to 32 carbon atoms are an alkyl group, an alkoxyalkyl group, an alkenyl group, an aryl group substituted with an alkyl group, an aryl group substituted with an alkoxy group, a terphenyl group, etc.

These hydrophobic groups can be substituted with a halogen atom such as a fluorine atom or a chlorine atom, a nitro group, a cyano group, an alkoxycarbonyl group, an amide group, a carbonyl group, a sulfonamide group, etc.

Preferred embodiments of the colored coupler of the general formula (I) are represented by the general formula (II)

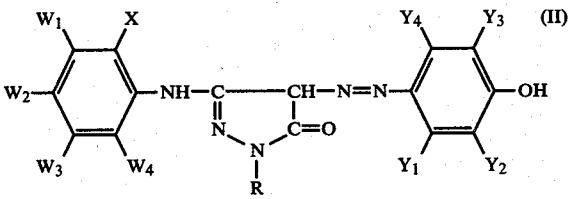

wherein R represents an aryl group or a heterocyclic group; X represents a halogen atom, an alkoxy group, or an aryloxy group; $W_1$, $W_2$, $W_3$, and $W_4$ each represents a hydrogen atom, an alkyl group, an aryl group, an alkoxy group, an aryloxy group, an alkylthio group, an arylthio group, an amino group, an amido group, a sulfamoyl group, a carbamoyl group, an alkoxycarbonyl group, a halogen atom, a hydroxyl group, a cyano group, or a nitro group; and $Y_1$, $Y_2$, $Y_3$ and $Y_4$ each represents a hydrogen atom, a halogen atom, an alkyl group, an aryl group, an alkoxy group, an aryloxy group, an alkylthio group, an arylthio group, an amino group, an amido group, a hydroxyl group, or a heterocyclic group; the coupler molecule having in the molecule at least one hydrophobic group having more than 8 carbon atoms capable of making the coupler diffusion resistant; by the general formula (II)

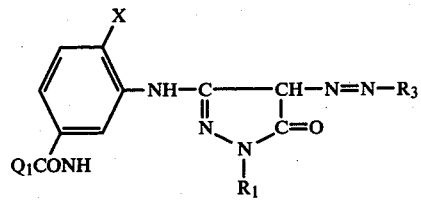

wherein $R_1$ and $R_3$ have the same significance as in the general formula (I); X represents a halogen atom or an alkoxy group; and $Q_1$ represents an alkyl group having 7 to 23 carbon atoms; by the general formula (IV)

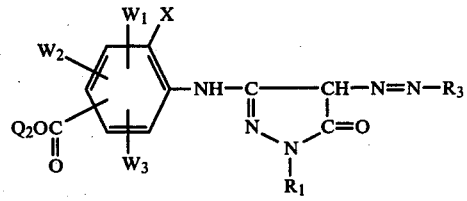

wherein $R_1$ and $R_3$ have the same significance as in the general formula (I); X, $W_1$, $W_2$, and $W_3$ have the same significance as in general formula (II); and $Q_2$ represents an alkyl group having 8 to 26 carbon atoms or an alkyl group substituted with an alkoxy group, an aryloxy group, an acyloxy group, an alkoxycarbonyl group, an acylamino group, or a carbamoyl group; by the general formula (V)

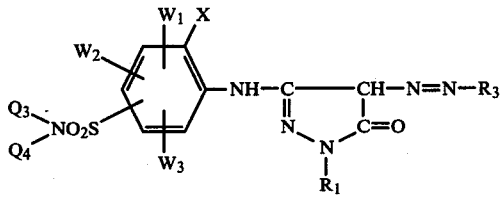

wherein $R_1$ and $R_3$ have the same significance as in the general formula (I); X, $W_1$, $W_2$, and $W_3$ have the same significance as in general formula (II); and $Q_3$ and $Q_4$ each represents an alkyl group having 8 to 26 carbon atoms or an alkyl group substituted with an alkoxy group, an aryloxy group, an acyloxy group, an alkoxycarbonyl group, an acylamino group, or a carbamoyl group and one of $Q_3$ and $Q_4$ may be a hydrogen atom.

A preferred group for R of the general formula (II) is a phenyl group represented by the following formula

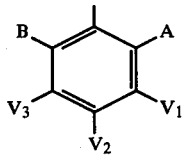

wherein A and B each represents a hydrogen atom, a halogen atom, an alkyl group, an alkoxy group, an alkylthio group, an aryl group, an aryloxy group, an arylthio group, or a cyano group, in which A and B are not simultaneously a hydrogen atom; and $V_1$, $V_2$, and $V_3$ each represents a hydrogen atom, a halogen atom, an alkyl group, an alkoxy group, an alkylthio group, an aryl group, an aryloxy group, an arylthio group, a cyano group, an acylamino group, a carbamyl group, a ureido group, a sulfonamido group, a sulfamyl group, an alkylsulfonyl group, an arylsulfonyl group, an alkylcarbonyl group, or an alkoxycarbonyl group.

Specific examples of hydrophobic groups which can be employed in the present invention are a 2-ethylhexyl group, an n-octyl group, a tert-octyl group, an n-nonyl group, an n-decyl group, an n-dodecyl group, a 1,1-dimethyldecyl group, a 2,2-dimethyldecyl group, an n-hexadecyl group, a 2-(n-hexyl)-decyl group, an n-octadecyl group, a 9,10-dichlorooctadecyl group, a heptyloxyethyl group, a 2,4-di-tert-amyloxyethyl group, a dodecyloxypropyl group, an oleyl group, a 2,4-di-tert-butylphenyl group, a 2,4-di-tert-amylphenyl group, a 2,4-di-tert-amyl-6-chlorophenyl group, a 3-n-pentadecylphenyl group, a 2-dodecyloxyphenyl group, a 3-heptadecyloxyphenyl group, an o-terphenyl group, a perfluoroheptyl group, etc.

The ballast group can be combined with the coupler skeleton directly or through an imino-, ether-, carbonamido-, sulfonamido-, ureido-, ester-, imido-, carbamoyl- or sulfamoyl-bond.

Some examples of ballast groups suitable for use in the coupler according to the invention are as follows:

(I) Alkyl groups and alkenyl groups e.g.,

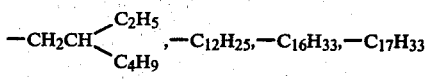

(II) Alkoxyalkyl groups e.g.,

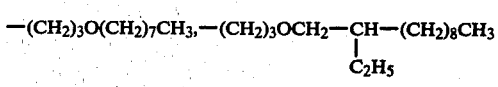

for example, as described in Japanese Patent Publication No. 27563/1964

(III) Alkylaryl groups

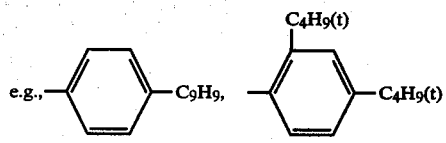

(IV) Alkylaryloxyalkyl groups

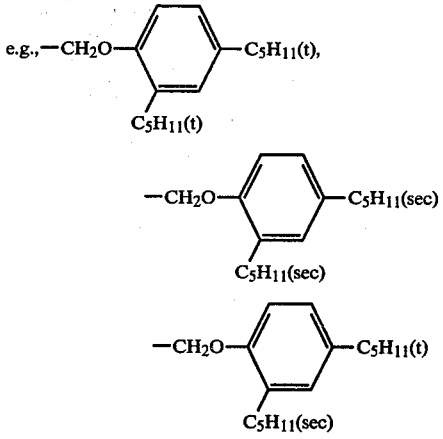

-continued

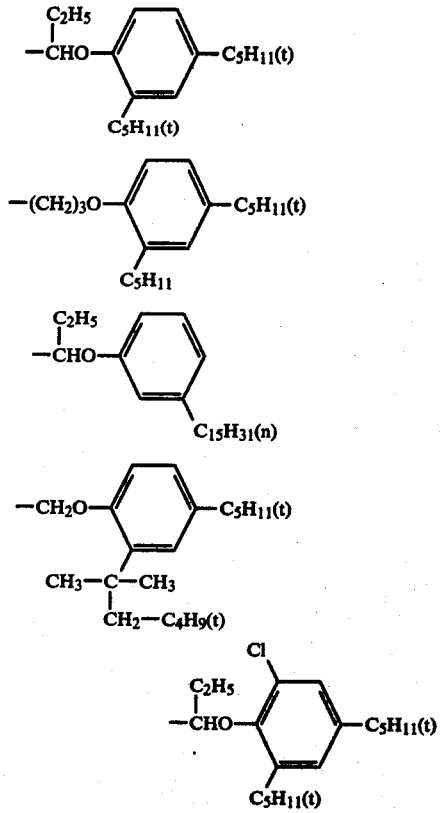

(V) Acylamidoalkyl groups e.g.,

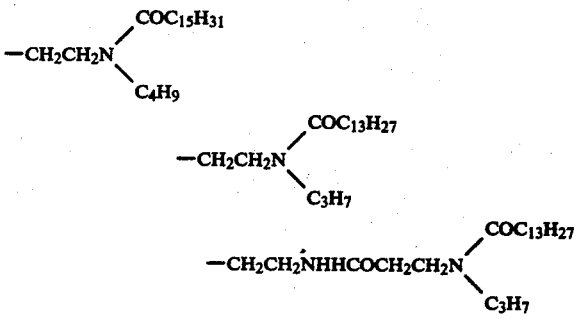

for example, as described in U.S. Pat. Nos. 3,337,344 and 3,418,129

(VI) Alkoxyaryl and Aryloxyaryl groups e.g.,

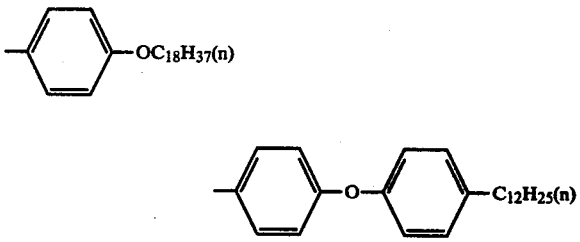

(VII) Long chain aliphatic groups such as alkyl or alkenyl groups having a water-solubilizing group such as a carboxyl or sulfo group e.g.,

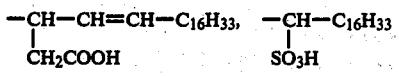

(VIII) Alkyl groups substituted with an ester group e.g.,

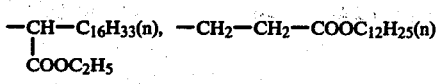

(IX) Alkyl groups substituted with an aryl group or a heterocyclic group e.g.,

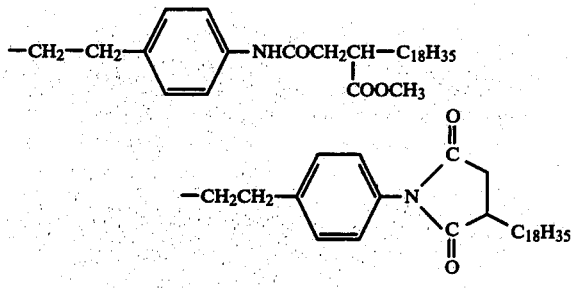

(X) Aryl groups substituted with an aryloxyalkoxycarbonyl group

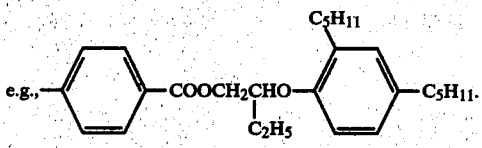

The hydrophobic group as described above is bonded at least to one of the groups represented by $R_1$, $R_2$, and $R_3$ of the general formula (I). In this case, the hydrophobic group can constitute per se the group represented by $R_1$, $R_2$ or $R_3$ or can be bonded to an aliphatic residue, an aromatic residue, or a heterocyclic group directly or through a divalent bond such as an ether bond, a thioether bond, an amido bond, a ureido bond, a sulfonamido bond, a carbonyl bond, an oxycarbonyl bond, an amino bond, etc.

Particularly useful examples of the group $R_2$ of the general formula (I) are a group having a sulfamoyl group as described in the specification of U.S. patent application Ser. No. 415,864, filed Nov. 13, 1973, a group having an alkoxycarbonyl group as described in the specification of U.S. patent application Ser. No. 415,853, filed Nov. 14, 1973, and a group having an acylamide group as described in the specification of U.S. patent application Ser. No. 445,032, filed Feb. 22, 1974.

It is believed that the colored coupler of the general formula (I) used in the color photographic material of this invention shows excellent effects due to the following structural features.

That is to say, the phenyl group at the 1-position of the pyrazolone, the anilino group substituted with a halogen atom, an alkoxy group, or an aryloxy group at the ortho-position to the —NH— group at the 3-position of the pyrazolone, and the phenylazo group at the 4-position of pyrazolone contribute to desirable light absorption characteristics having less undesired absorption in a green region.

Also, the anilino group at the 3-position of pyrazolone and the p-hydroxyphenylazo group at the 4-position contribute to the increase of the development activity of the coupler.

Also, due to the presence of the hydrophobic diffusion resisting or ballasting group in the molecule of the coupler, the oleophilic properties of the colored coupler increase and the coupler can be added to a silver halide emulsion as an organic solvent solution thereof or as an emulsified dispersion of the organic solvent solution thereof in a hydrophilic medium instead of using a high-alkaline aqueous solution of the coupler. Therefore, a stable coating composition of the colored coupler showing less viscosity change and requiring no neutralization step with alkali is obtained.

The phenylazo group at the 4-position of pyrazolone contributes to the diazotization of the corresponding aniline and introduce it by the coupling reaction with 5-pyrazolone but in the case of the coupler having a naphthylazo group at the 4-position of 5-pyrazolone as described in the specification of U.S. Pat. No. 3,615,506, it is necessary to diazotize $\alpha$-naphthylamine and subject the diazotized product to a coupling reaction with 5-pyrazolone.

Serious difficulties in the production of the coupler are encountered in using as the raw material $\alpha$-naphthylamine which may contain $\beta$-naphthylamine known as a carcinogenic substance. On the other hand, the preparation of the colored coupler of this invention does not require the use of such a troublesome raw material.

The colored dyes obtained from the colored couplers of this invention are excellent in spectral absorption characteristics and fastness and in particular the colored couplers having a $R_2$ group as described in the specifications of U.S. patent application Ser. Nos. 415,865, filed Nov. 13, 1973, 415,853, filed Nov. 14, 1973 and 445,032, filed Feb. 22, 1974 are excellent as disclosed in those specifications.

Specific examples of the colored couplers used in this invention are illustrated below but the colored couplers used in this invention are not limited to these examples only.

Coupler (1):

1-(2,4,6-Trichlorophenyl)-3-(2-chloro-5-n-tetradecyloxycarbonylanilino)-4-(4-hydroxyphenylazo)-2-pyrazoline-5-one;

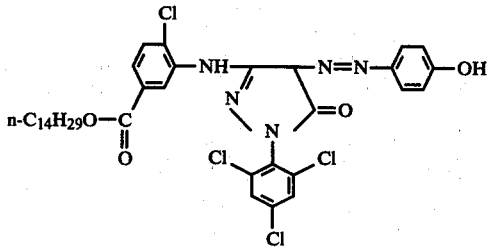

Coupler (2):

1-(2,6-Dichloro-4-methoxyphenyl)-3-(2-chloro-4-hexadecyloxycarbonylanilino)-4-(2-methyl-4-hydroxyphenylazo)-2-pyrazoline-5-one;

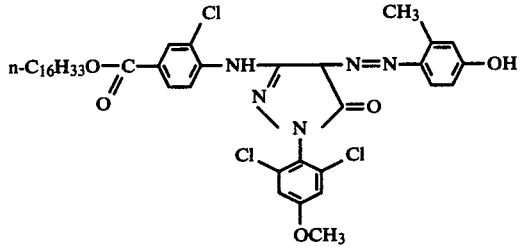

Coupler (3):

1-(2,4,6-Trichlorophenyl)-3-{2-chloro-5-[β-(2,4-di-tert-amylphenoxy)ethoxycarbonyl]anilino}-4-(3-tert-butyl-4-hydroxyphenylazo)-2-pyrazoline-5-one;

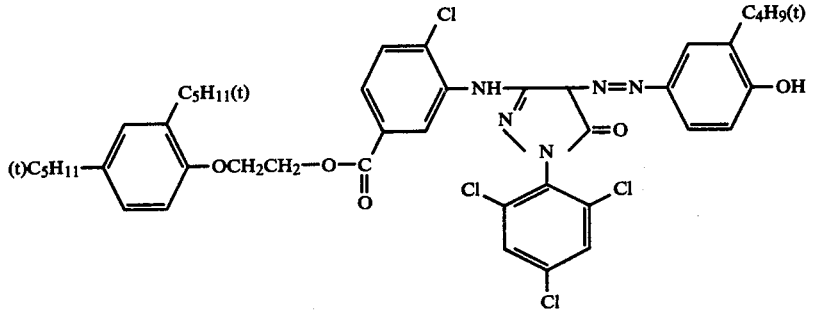

Coupler (4):

1-(2,4,6-Trichlorophenyl)-3-(2-chloro-5-n-tetradecanoylaminoanilino)-4-(4-hydroxyphenylazo)-2-pyrazoline-5-one;

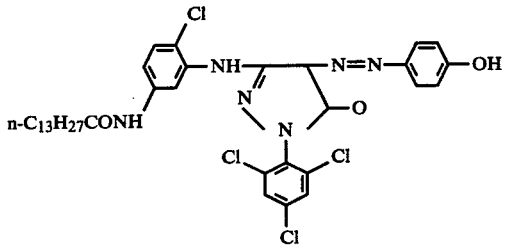

Coupler (5):

1-(2,4,6-Dichloro-4-methoxyphenyl)-3-(2-chloro-4-n-dodecanoylaminoanilino)-4-(3-sec-butyl-4-hydroxyphenylazo)-2-pyrazoline-5-one;

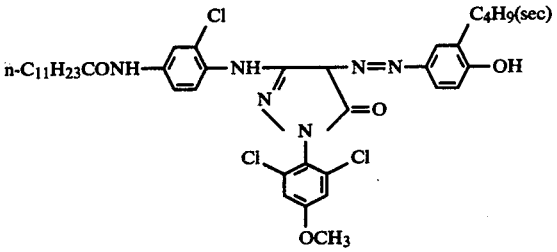

Coupler (6):

1-(2,4,6-Trichlorophenyl)-3-(2-chloro-5-tetradecanoylaminoanilino)-4-(3-methyl-4-hydroxyphenylazo)-2-pyrazoline-5-one;

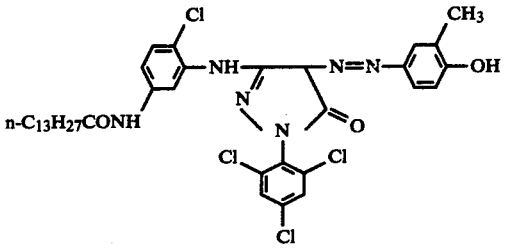

Coupler (7):

1-(2,4-Dichloro-6-methylphenyl)-3-(2-chloro-5-n-hexadecanoylaminoanilino)-4-(4-hydroxy-2-methyl-5-isopropylphenylazo)-2-pyrazoline-5-one;

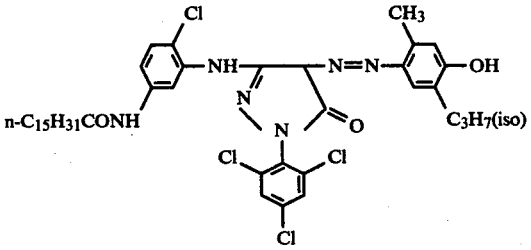

Coupler (8):

1-(2,4,6-Trichlorophenyl)-3-(2-methoxy-4-octadecanoylaminoanilino)-4-(2,6-dimethyl-4-hydroxyphenylazo)-2-pyrazoline-5-one;

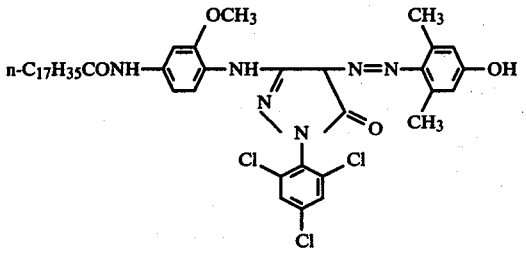

Coupler (9):

1-{4-[α-(2,4-Di-tert-amylphenoxy)butylamido]phenyl}-3-(2,4-dichloroanilino)-4-(3-n-octyl-4-hydroxyphenylazo)-2-pyrazoline-5-one;

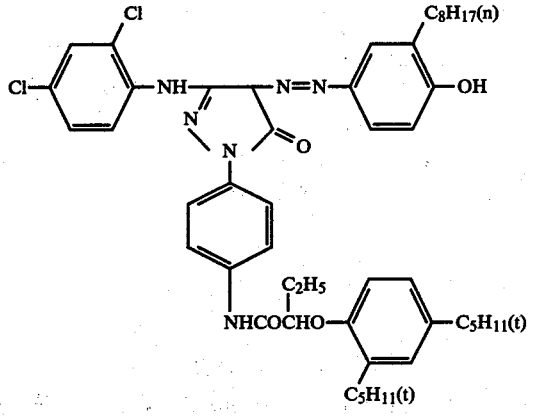

Coupler (10):

1-(2,5-Dichlorophenyl)-3-(2-n-dodecyloxyanilino)-4-(3-tert-butyl-4-hydroxyphenylazo)-2-pyrazoline-5-one;

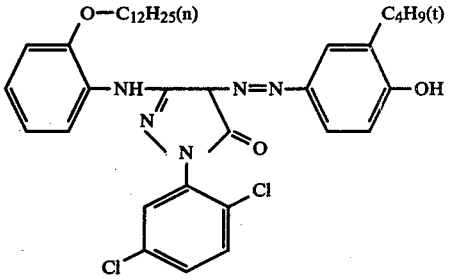

Coupler (11):

1-(2,4,6-Trichlorophenyl-3-(2-chloro-4-n-tetradecylsulfamoylanilino)-4-(3-ethyl-4-hydroxyphenylazo)-2-pyrazoline-5-one;

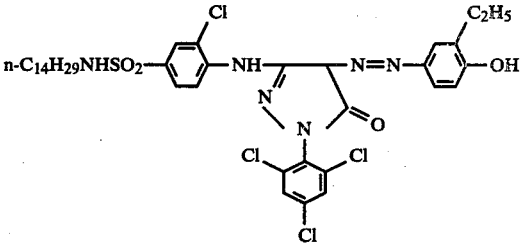

Coupler (12):

1-(2,6-Dichloro-4-methoxyphenyl-3-[2-chloro-5-{γ-(2,4-di-tert-amylphenoxy)propylsulfamoyl}anilino]-4-(4-hydroxyphenylazo)-2-pyrazoline-5-one;

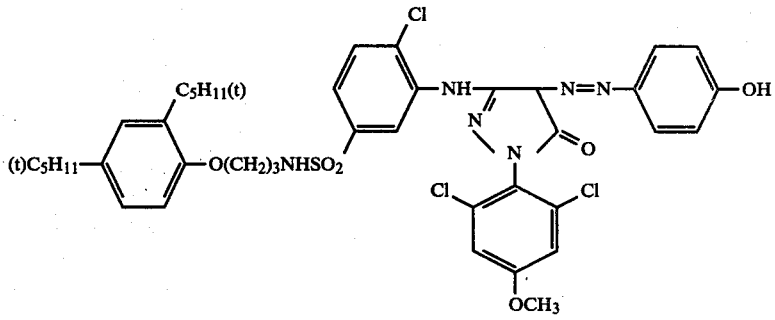

Coupler (13):

1-(2,4-Dimethyl-6-chlorophenyl)-3-{2-chloro-5-[β-(dodecylsuccinamido)ethoxycarbonyl]anilino}-4-(4-hydroxyphenylazo)-2-pyrazoline-5-one;

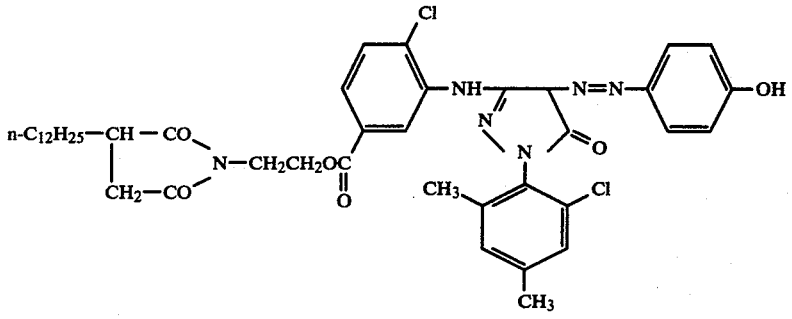

Coupler (14):

1-(2,6-Dichloro-4-methylphenyl)-3-[2-chloro-5-{β-(3-tert-butyl-4-hydroxyphenoxy)tetradecyloxycarbonyl}-anilino]-4-(3-methyl-4-hydroxyphenylazo)-2-pyrazoline-5-one;

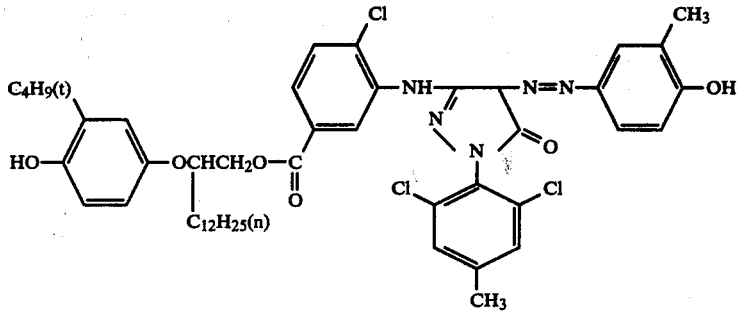

Coupler (15):

1-(2,4,6-Trichlorophenyl)-3-[2-methoxy-4-{β-(3-tert-octyl-4-hydroxyphenoxy)dodecylsulfamoyl}anilino]-4-(3,5-dimethyl-4-hydroxyphenylazo)-2-pyrazoline-5-one;

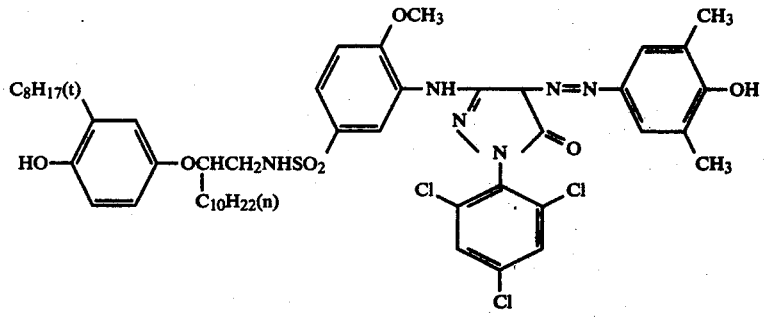

Coupler (16):

1-(2,5-Dichlorophenyl)-3-[2-chloro-5-{α-(3-tert-butyl-4-hydroxyphenoxy)hexadecanoylamino}anilino]-4-(2-methyl-4-hydroxyphenylazo)-2-pyrazoline-5-one;

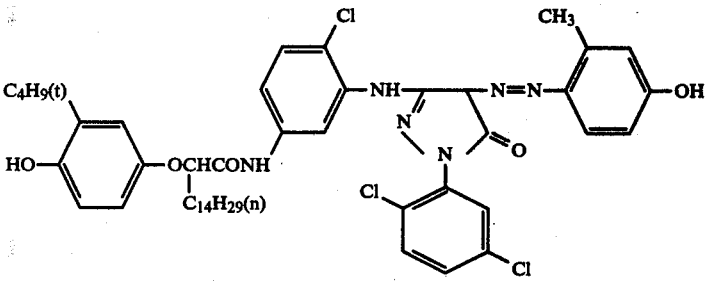

Coupler (17):

1-(2,4,6-Trichlorophenyl)-3-[2-chloro-5-{β-(n-butoxy)-n-tetradecanoylcarbonyl}anilino]-4-(2-methyl-4-hydroxydiphenylazo)-2-pyrazoline-5-one;

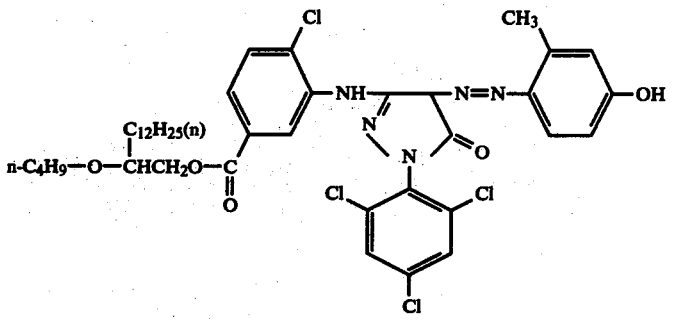

Coupler (18):

1-(2,6-Dichloro-4-methylphenyl)-3-(2-chloro-5-n-dodecyloxycarbonylmethoxycarbonylanilino)-4-(3-tert-butyl-4-hydroxyphenylazo)-2-pyrazoline-5-one;

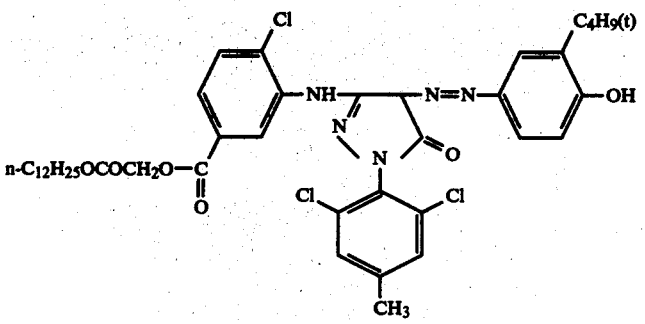

Coupler (19):

1-(4-Chlorophenyl)-3-[2-chloro-5-{α-(4-tert-amylphenoxy)tetradecanoylamino anilino}]-4-(4-hydroxyphenylazo)-2-pyrazoline-5-one;

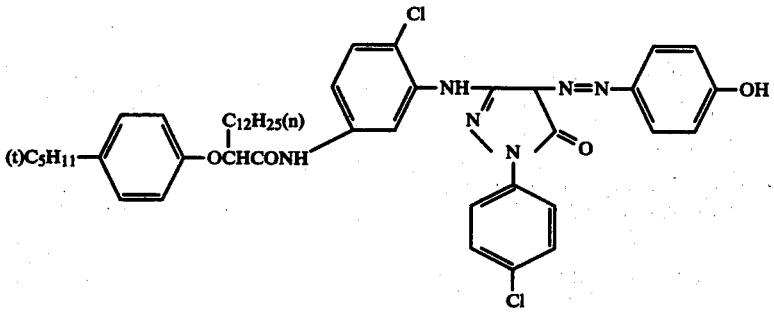

Coupler (20):

1-(2,4,6-Trichlorophenyl)-3-[2-methoxy-5-{β-(dodecylsuccinimido)ethylsulfamoyl}anilino]-4-(2,6-dimethyl-4-hydroxyphenylazo)-2-pyrazoline-5-one;

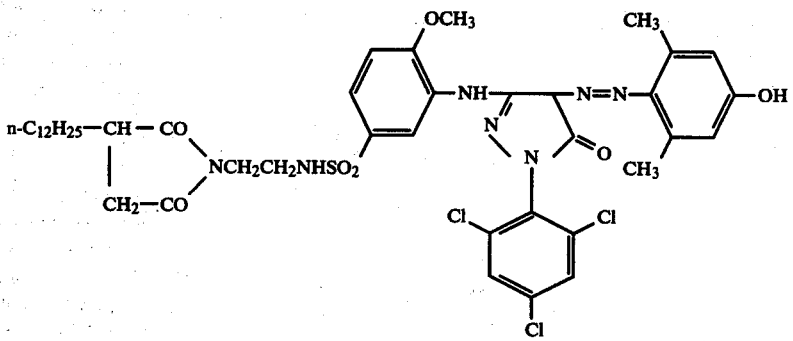

Coupler (21):

1-(2,4-Dichloro-6-methylphenyl)-3-{2-methoxy-5-(N-methyl-N-n-octadecylsulfamoyl)anilino}4-(3-ethyl-4-hydroxyphenylazo)-2-pyrazoline-5-one;

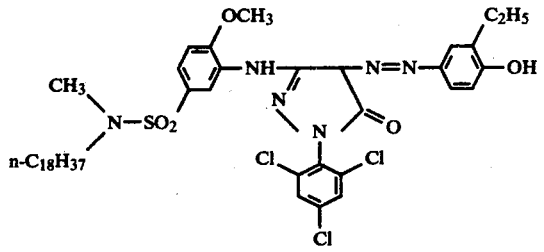

Coupler (22):

1-(2,4,6-Trichlorophenyl)-3-(2-dodecyloxy-5-cyclohexylsulfamoylanilino)-4-(3-n-butyl-4-hydroxyphenylazo)-2-pyrazoline-5-one;

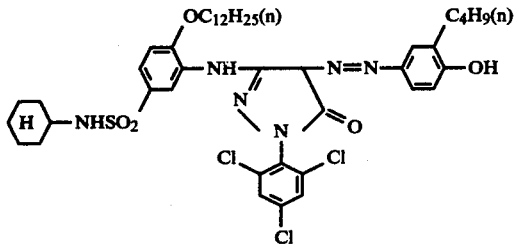

Coupler (23):

1-(2,4,6-Trichlorophenyl)-3-(2-chloro-5-n-tetradecylcarbamoylanilino)-4-(3-methyl-4-hydroxyphenylazo)-2-pyrazoline-5-one;

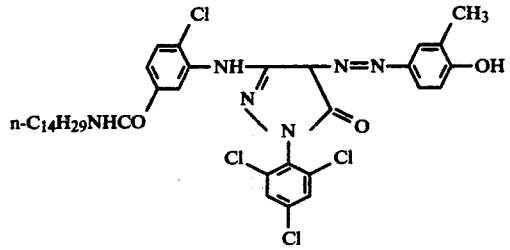

Coupler (24):

1-(2,4-Dichloro-6-methylphenyl)-3-[2-methoxy-5-{γ-(2,4-di-tert-amylphenoxy)propylcarbamoyl}anilino]-4-(3-sec-butyl-4-hydroxyphenylazo-2-pyrazoline-5-one;

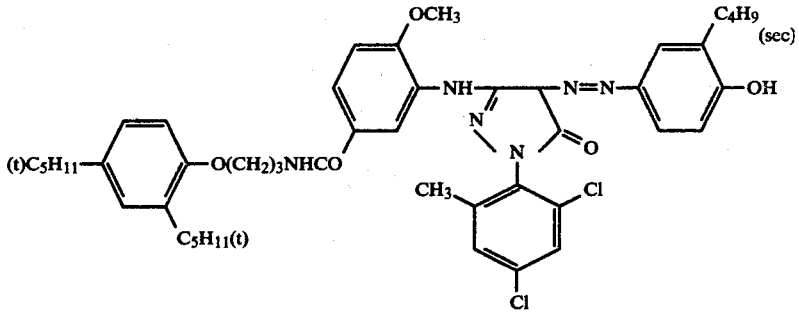

Coupler (25):

1-(2,4,6-Trichlorophenyl)-3-(2-chloro-5-tetradecylaminoanilino)-4-(3-tert-butyl-4-hydroxyphenylazo)-2-pyrazoline-5-one;

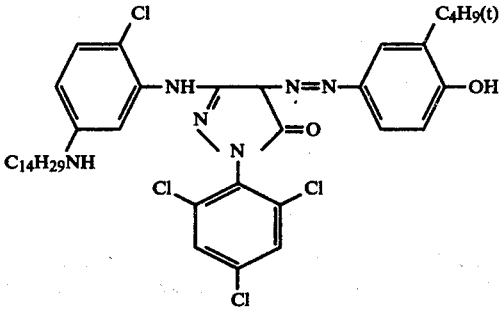

The colored couplers used in this invention can be prepared by the methods as described in the specification of U.S. Pat. No. 2,983,608.

The colored couplers used in this invention can be incorporated in photographic emulsions using various methods. A suitable amount of the colored coupler ranges from about $10^{-4}$ to 1 mole, preferably $10^{-3}$ to $10^{-1}$ per mole of silver halide. Typical examples of methods which can be used to incorporate the colored couplers used in this invention are illustrated below:

(a) The colored coupler can be dissolved in an organic solvent which is sparingly soluble in water and has a high boiling point (usually higher than 200° C.), the coupler solution is dispersed by emulsification in an aqueous medium, and the emulsified dispersion is added to a photographic emulsion. Examples of organic solvents which can be suitably employed in this method are dibutyl phthalate, tricresyl phosphate, N,N-diethylcapronic acid amide, p-n-nonylphenol, p-methyl-4-n-octylphenol, etc.

(b) The colored coupler can be dissolved in a low boiling solvent (e.g., having a boiling point ranging from about 20° to 100° C.) which is comparatively sparingly soluble in water, the coupler solution is dispersed by emulsification in an aqueous medium, and the emulsified dispersion is added to a photographic emulsion. The organic solvent used is removed during the production of the color photographic materials. Examples of organic solvents which can be suitably used in this method are ethyl acetate, cyclohexanone, β-butylethoxyethyl acetate, etc.

(c) The colored coupler can be dissolved in an organic solvent miscible with water and the coupler solution is added to a photographic emulsion. In this case the coupler is dispersed as fine colloidal particles in the emulsion. The organic solvent used may be removed during the production of the color photographic materials or may remain in the photographic emulsion layer. Examples of solvents suitable for use in this method are dimethylformamide, dimethylsulfoxide, N-methylpyrrolidone, glycerine, tetrahydrofuran, etc.

Also, the dispersion of the coupler can be improved by using a mixture of the solvents as illustrated in the above-described methods (a), (b) and (c), if desired, in accordance with the solubility of the coupler.

In the above methods, a dispersion aid is usually used in dispersing the coupler solution and as such a dispersion aid, an anionic surface active agent (such as sodium alkylbenzenesulfonate, sodium dioctylsulfosuccinate, sodium dodecylsulfate, sodium alkylnaphthalenesulfonate, a Fischer type coupler, etc.), an amphoteric surface active agent (such as N-tetradecyl-N,N-dipolyethylene α-betaine, etc.), and a nonionic surface acitve agent (such as sorbitan monolaurate, etc.) are usually used.

Also, when the colored coupler of this invention is used together with any of the conventional 5-pyrazolone type colorless magenta couplers, the blue absorption deficiency can be corrected and sufficient masking effect can be obtained. For instance, examples of the 5-pyrazolone type colorless magenta couplers for which color correction can be achieved by use together with the colored coupler of this invention are those couplers described in the specifications of U.S. Pat. Nos. 2,600,788; 3,062,653; 3,558,319; 3,127,269; 3,684,514; and U.S. patent application Ser. Nos. 415,864, filed Nov. 13, 1973, 415,853, filed Nov. 14, 1973 and 445,032, filed Feb. 22, 1974.

The colored couplers of this invention can be used individually or can be used as a combination of two or more such couplers. Furthermore, the colored couplers of this invention can also be used together with other colored coupler or couplers than those of this invention. Still further, the 5-pyrazolone type colorless magenta couplers used together with the colored coupler of this invention can be used individually or as a combination thereof.

Moreover, the colored coupler of this invention can be used together with other 5-pyrazolone type colorless coupler as indicated above, such as, for instance, a cyanoacetyl derivative, an indazolone derivative, a pyrazolonebenzimidazole derivative, etc., in addition to the 5-pyrazolone type colorless coupler. Examples of these additional couplers are described in the specifications of U.S. Pat. Nos. 3,061,432 and 3,733,335.

Also, the colored coupler of this invention can be used in the same photographic emulsion layer containing a cyan coupler or a yellow coupler for improving the color reproducibility of the color photographic material as described in the specification of Japanese Patent Publication No. 391/1965.

The colored coupler of this invention can be also used together with a so-called D. I. R. coupler as described in the specifications of U.S. Pat. Nos. 3,227,551 and 3,632,345 or a color correction coupler as described in the specification of U.S. patent application Ser. No. 454,525, filed Mar. 25, 1974, corresponding to Japanese Patent Application No. 33,238/1973 for further improving the color reproducibility of the color photographic material.

Furthermore, the colored coupler of this invention can be used together with the colorless coupler as described in the specification of Belgian Pat. No. 746,394.

The silver halide emulsion used for the color photographic material of this invention is usually prepared by mixing an aqueous solution of a water-soluble silver salt such as silver nitrate and an aqueous solution of a water-soluble halide such as potassium bromide in the presence of an aqueous solution of a water-soluble polymer such as gelatin. As the silver halide, there are silver chloride and silver bromide as well as mixed silver halides such as silver chlorobromide, silver iodobromide, silver chloroiodobromide, etc. Preferred examples of the silver halide are silver iodobromide containing more than one mol percent silver iodide and silver chlorobromide containing more than one mol percent silver iodide. The form of these silver halide grains can be of a cubic system, an octahedral system, or a mixed crystal system.

The silver halide grains used in this invention can be prepared in a conventional manner. For example, a single jet system, a double jet system, or a control jet system can, of course, be employed for making the preparation thereof advantageously. Moreover, two or more silver halide photographic emulsions can be prepared separately and then combined.

Furthermore, the silver halide grains used in this invention can have a homogeneous crystal structure, or can have a layer structure having an outside layer portion of which the quality is different from that of the inside portion of the grain, or can be of the so-called conversion type as described in the specifications of British Pat. No. 635,841 and U.S. Pat. No. 3,622,318.

Also, the silver halide grains can be of the type forming a latent image mainly on the surface thereof or can be of a so-called internal latent image type forming a latent image in the inside of the silver halide grain. Such silver halide photographic emulsions can be prepared by, for instance, the ammonia method, the neutralization method, the acidic method, etc., as described in, e.g., Mess, *The Theory of Photographic Process,* published by MacMillan Co. and Grafikides, *Photographic Chemistry,* published by Fountain Press. After formation of the silver halide grains, they are washed with water to remove the water-soluble salts (e.g., potassium nitrate when silver bromide is formed using silver nitrate and potassium bromide) from the system and then subjected to a heat treatment in the presence of a chemical sensitizer to increase the sensitivity of the silver halide grains without coarsening the grains. Those processes are generally described in the above-indicated publications.

Examples of hydrophilic colloids which can be used as the vehicle for the silver halide grains are gelatin; colloidal albumin; casein; a cellulose derivative such as carboxymethyl cellulose, hydroxyethyl cellulose, etc.; agar agar; a sugar derivative such as sodium alginate, a starch derivative, etc.; and a synthetic hydrophilic colloid such as polyvinyl alcohol, poly-N-vinyl pyrrolidone, a polyacrylic acid copolymer, a polyacrylamide, derivatives thereof, etc. If desired a mixture of two or more of these colloids which are miscible with each other can be used. Among the above-described colloids, gelatin is most generally used but a part or all of the gelatin can be replaced with a synthetic polymer as described above. Furthermore, a gelatin derivative, namely a gelatin treated with a reagent having a group capable reacting with an amino group, an imino group, a hydroxyl group, or a carboxyl group contained in the molecule as a functional group can be used and also a graft polymer of gelatin prepared by bonding the molecular chain of another polymer to the gelatin can be used.

Examples of reagents for preparing the above-described gelatin derivative are the isocyanates, the acid chlorides, and the acid anhydrides as described in the specification of U.S. Pat. No. 2,614,928, the acid anhydrides as described in the specification of U.S. Pat. No. 3,118,766, the bromoacetic acids as described in the specification of Japanese Patent Publication No. 5514/1964, the phenylglycidyl ethers as described in the specification of Japanese Patent Publication No. 26845/1967, the vinylsulfone compounds as described in the specification of U.S. Pat. No. 3,132,945, the N-allylvinylsulfonamides as described in the specification of British Pat. No. 861,414, the maleinimide compounds as described in the specification of U.S. Pat. No. 3,186,846, the acrylonitriles as described in the specification of U.S. Pat. No. 2,596,293, the polyalkyleneoxides as described in the specification of U.S. Pat. No. 3,312,553, the epoxy compounds as described in the specification of Japanese Patent Publication No. 26845/1967, the esters as described in the specification of U.S. Pat. No. 2,763,639, and the alkanesultones as described in the specification of British Pat. No. 1,033,189 and U.S. Pat. No. 3,539,353.

Also, examples of the chain polymers which can be grafted to gelatin as indicated above are various polymers and copolymers of the so-called vinyl monomers such as acrylic acid, methacrylic acid, ester derivatives thereof, amide derivatives thereof, nitrile derivatives thereof, and styrene as described in, for instance, the specifications of U.S. Pat. Nos. 2,763,625; 2,831,767; and 2,956,884 and also in *Royal Letters;* 5, 595(1967), *Photographic Science Engineering;* 9, 148(1965), and *Journal of Polymer Science;* A-1, 9, 3199(1971). However, particularly desirable polymers or copolymers which can be used for this purpose are hydrophilic vinylic polymers or copolymers having some miscibility with gelatin such as the polymers or copolymers of acrylic acid, acrylamide, methacrylamide, hydroxyacrylate, hydroxyalkyl methacrylate, etc.

The photographic emulsion can be hardened in a conventional manner. Examples of hardening agents which can be employed for this purpose are aldehyde compounds such as formaldehyde, glutaraldehyde, etc.; ketone compounds such as diacetyl, cyclopentadione, etc.; reactive halogen containing compounds such as bis(2-chloroethylurea); and 2-hydroxy-4,6-dichloro-1,3,5-triazine, or those described in the specifications of U.S. Pat. Nos. 3,288,775 and 2,732,303 and British Pat. Nos. 974,723 and 1,167,207; compounds having a reactive olefinic group such as divinylsulfone, 5-acetyl-1,3-diacryloylhexahydro-1,3,5-triazine, etc., or those described in the specifications of U.S. Pat. Nos. 3,635,718 and 3,232,763 and British Pat. No. 994,869; the N-methylol compounds such as N-hydroxymethylphthalimide, or those described in the specifications of U.S. Pat. Nos. 2,732,316 and 2,586,168; the isocyanates as described in the specification of U.S. Pat. No. 3,103,437; the aziridine compounds as described in the specifications of U.S. Pat. Nos. 3,017,280 and 2,983,611; the acid derivatives as described in the specifications of U.S. Pat. Nos. 2,725,294 and 2,725,295; the carbodiimide compounds as described in the specification of U.S. Pat. No. 3,100,704; the epoxy compounds as described in the specification of U.S. Pat. No. 3,091,537; the isooxazole compounds as described in the specifications of U.S. Pat. Nos. 3,321,313 and 3,543,292; halocarboxyaldehydes such as mucochloric acid; dioxane derivatives such as dihydroxydioxane, dichlorodioxane, etc.; and inorganic hardening agents such as chromium alum, zirconium sulfate, etc.

Also, precursors such as, for instance, an alkali metal bisulfitealdehyde addition product, a methylol derivative of hydantoin, and a primary aliphatic nitro alcohol can be used instead of the above-described compounds as the hardening agent for the photographic emulsions.

The above-described photographic emulsion can be sensitized with a chemical sensitizer. Examples of suitable chemical sensitizers are gold trichloride, etc.; salts of noble metals such as platinum, palladium, iridium, rhodium, ruthenium, etc., as described in the specifications of U.S. Pat. Nos. 2,448,060; 2,540,086; 2,566,245; 2,566,263; and 2,598,079; sulfur compounds capable of forming silver sulfide by reaction with silver salts as described in the specifications of U.S. Pat. Nos. 1,574,944; 2,410,689; 3,189,458; and 3,501,313; the stannous salts and the amines as described in the specifications of U.S. Pat. Nos. 2,487,850; 2,518,698; 2,521,925; 2,521,926; 2,694,637; 2,983,610; and 3,201,254; and other reducing materials.

Also, spectral sensitization methods which have conventionally been used in producing color photographic materials can be applied to the photographic emulsions used in this invention.

The silver halide photographic emulsion used in this invention can further contain an antifoggant and/or a stabilizer. Examples of such antifoggants and stabilizers are the mercury (II) compounds such as mercuric oxide as described in the specification of U.S. Pat. No. 3,567,454; the sodium polyaminopolycarboxylate-mercury (II) chelate compounds as described in the specification of U.S. Pat. No. 3,595,662; the complex salts of organic iodonium compounds and mercury (II) compounds as described in the specification of U.S. Pat. No. 3,554,758; the molecular addition compounds of nitrogen-containing compounds and mercuric halides as described in the specification of U.S. Pat. No. 2,728,663; the mercuric salts as described in the specification of U.S. Pat. No. 2,728,665; the compounds having heterocyclic compounds bonded thereto as described in the specification of U.S. Pat. No. 2,728,665; the compounds consisting of mercury and the heterocyclic compounds as described in the specification of U.S. Pat. No. 3,137,577; the sulfonamides having a N-mercury bond and the sulfonium-mercury complex salts as described in the specification of U.S. Pat. No. 3,420,668; the benzothiazolium salts and benzoselenazolium salts as described in the specifications of Japanese Pat. No. 21827/1967 and U.S. Pat. Nos. 2,131,038 and 2,694,716; the benzimidazoles and benzindazoles as described in the specifications of British Pat. No. 403,789 and U.S. Pat. Nos. 1,696,830; 2,271,229; and 2,324,123; the mercaptotetrazoles as described in the specifications of U.S. Pat. Nos. 2,403,927; 2,453,087; 2,465,149; 2,697,040; etc.; known 1-phenyl-2-tetrazoline-5-thions and mercaptopyrimidines; the nitrogen-containing teterocyclic compounds having a mercapto group or thioxo group as described in the specifications of U.S. Pat. Nos. 3,251,691; 2,697,009; 2,759,821; and 2,824,001; the tetraazaindenes and pentaazaindenes as described in the specifications of U.S. Pat. Nos. 2,444,605; 2,444,606;

2,444,607; and 2,886,437 and British Pat. Nos. 648,185 and 893,428; the benzenesulfinic acids as described in the specifications of U.S. Pat. Nos. 2,057,764 and 2,394,198; the sulfocatechols and the dihydroxynaphthalene-sulfonic acids as described in the specification of U.S. Pat. No. 3,236,652; the urazoles, parabanic acid, and hydantoin as described in the specifications of U.S. Pat. Nos. 2,708,162 and 3,287,135; the isothioureas as described in the specification of U.S. Pat. No. 3,220,839; the oximes as described in the specification of British Pat. No. 623,448; the noble metal complex compounds and salts as described in the specifications of U.S. Pat. Nos. 2,566,245; 2,566,263; 2,597,856; and 2,597,915; the water soluble inorganic acid salts of cadmium, cobalt, manganese, and zinc as described in the specification of U.S. Pat. No. 2,839,405; the cobalt chelates and manganese chelates of polyaminopolycarboxylic acids as described in the specification of U.S. Pat. No. 3,556,797; the mercaptothiazoles as described in the specification of U.S. Pat. No. 1,758,576; glutathione as described in the specification of U.S. Pat. No. 2,173,628; the aminohydroxypyrimidines as described in the specification of U.S. Pat. No. 2,173,628; the dimercaptooxothiapyran derivatives as described in the specifications of U.S. Pat. Nos. 1,758,576 and 2,214,446; the mercaptotriazine derivatives as described in the specification of U.S. Pat. No. 2,476,536; the poly(N-vinyl-2-pyrrolidone) compounds as described in U.S. Pat. Nos. 2,995,444 and 3,052,544; the 1,3-bis(3-amino-1,2,4-triazole-2-yl)-2-propene-1-one derivatives as described in U.S. Pat. No. 2,444,608; the s-triazine polycondensates as described in the specification of U.S. Pat. No. 3,622,339; and further the thioanilides, pyrazoles, pyrazolones, secondary and tertiary aromatic amines, monoacetylaminophenols, diacetylaminophenols, chloranils, chloroacetamides, acetylenic compounds, and complex salts and double salts of the elements belonging to Group III of the periodic table as described in *The Theory of the Photographic Process*, Revised Edition (1954) and Third Edition (1966).

It is advantageous for improving the stability of the color photographic material of this invention that the color photographic material contains in the silver halide emulsion layer the 3-anilino-4-phenylazo-2-pyrazole-5-one represented by the general formula (I) described above together with a p-substituted phenol derivative. Specific examples of such a p-substituted phenol derivative suitable particularly for the color photographic material of this invention are the hydroquinone derivatives as described in the specifications of U.S. Pat. Nos. 2,360,290; 2,418,613; 2,675,314; 2,701,197; 2,704,713; 2,728,659; 2,732,300; 2,735,765; 2,710,801; and 2,816,028; the gallic acid derivatives as described in the specifications of U.S. Pat. Nos. 3,457,079; 3,069,262; and 3,457,079; the p-alkoxyphenols as described in the specifications of U.S. Pat. No. 2,735,765 and 3,698,909; and the p-oxyphenols derivatives as described in the specifications of U.S. Pat. Nos. 3,432,300; 3,573,050; 3,574,627; and 3,764,337. Also, it is advantageous to incorporate in the silver halide emulsion layer the D. I. R. hydroquinone as described in the specification of U.S. Pat. No. 3,620,746.

The silver halide photographic emulsion layers and other layers of the color photographic materials of this invention can further contain other synthetic polymers, e.g., a vinyl polymer latex, in particular, a polymer for improving the dimensional stability of the photographic materials individually or together with a hydrophilic water-permeable colloid. Various polymers used for the purpose are known. For instance, they are described in the specifications of U.S. Pat. Nos. 2,376,005; 2,739,137; 2,853,457; 3,062,674; 3,411,911; 3,488,708; 3,525,620; 3,635,715; 3,607,290; 3,645,740; etc., and British Pat. Nos. 1,186,699 and 1,307,373. These materials are generally copolymers but in some cases the materials are homopolymers.

The above-described silver halide photographic emulsions are coated on a hard support such as a glass plate, a metallic sheet, and a ceramic material or a flexible support according to the end-use purposes. Typical examples of flexible supports are supports usually used for photographic materials, such as a cellulose nitrate film, a cellulose acetate film, a cellulose acetate butyrate film, a cellulose acetate propionate fiml, a polystyrene film, a polyethylene terephthalate film, a polycarbonate film, a laminate of these films, a thin glass sheet, and a paper. If the adhesiveness between the support and the photographic emulsion layer is insufficient, a layer having good adhesive properties to both the support and the emulsion layer is employed as a subbing layer. Also, for further improving the adhesive properties of the support, the surface of the support can be pre-treated by using a corona discharge, an ultra-violet radiation, a flame treatment, etc. A suitable coating amount of the colored coupler is about $10^{-6}$ to $10^{-2}$, preferably $10^{-5}$ to $10^{-3}$ mole of coupler per $m^2$ of the support.

The silver halide photographic emulsions as indicated above can be coated on the support as described above using various techniques such as dip coating, air knife coating, curtain coating, and extrusion coating using the hopper as described in the specification of U.S. Pat. No. 2,681,294. If desired, also, two or more photographic layers can be coated simultaneously using the method as described in the specifications of U.S. Pat. Nos. 2,761,791; 3,508,947; 2,941,189; 3,526,528; etc.

When the color photographic material is used as a color negative material, the color photographic material has, in addition to the green-sensitive emulsion layer containing the colored coupler represented by general formula (I), a blue-sensitive emulsion layer containing a yellow forming coupler such as an acylacetamide and dibenzoylmethane and a red-sensitive emulsion layer containing a cyan forming coupler such as phenol or α-naphthol. As the yellow forming coupler which can be used in this case, there are illustrated the benzoylacetamides as described in the specifications of U.S. Pat. Nos. 3,551,155 and 3,551,156 and U.S. patent application Ser. No. 319,806, filed Dec. 29, 1972 and the pivaloylacetamides as described in the specifications of U.S. Pat. No. 3,265,506 and U.S. patent application Ser. No. 235,937, filed Mar. 20, 1972. Also, as the cyan forming coupler, there are illustrated the phenols as described in the specifications of U.S. Pat. Nos. 3,558,700 and 2,908,573; the α-naphthols as described in the specifications of U.S. Pat. No. 3,591,383 and U.S. Pat. No. 2,474,293; and the colored cyan couplers as described in the specification of U.S. Pat. No. 3,642,485. Each of the green-sensitive emulsion layer, the blue-sensitive emulsion layer, and the red-sensitive emulsion layer can be a single layer or can be composed of two or three layers each having substantially the same sensitive region. When the green-sensitive emulsion layer as described above is composed of two or three layers, the proportions of the colored coupler represented by the general formula (I) can differ in each layer. Also, if desired, the colored coupler represented by the general formula (I)

can be incorporated in only one of the two layers or in only one or two of the three layers.

Each of the blue-sensitive emulsion layer and the red-sensitive emulsion layer as described above can also contain various additives as described in regard to the green-sensitive emulsion layer containing the colored coupler of this invention.

Also, the color photographic material can have, if desired, an antihalation layer, intermediate layers, a yellow filter layer, and a protective layer at appropriate positions in addition to the above-described silver halide emulsion layers. In this case the intermediate layer can contain, in addition to a hydrophilic colloid, the hydroquinone derivative, the D. I. R. hydroquinone, and the anti-irradiation dyes as described above.

The color photographic material of this invention can be also used advantageously as photographic materials in a monochromatic system, such as, for instance, a color radiographic material, a microphotographic material, and a photographic material for display film as disclosed in British Pat. No. 1,236,690.

The color photographic material of this invention is processed using a color developer containing a p-phenylenediamine derivative or a p-aminophenol derivative as a color developing agent. Suitable examples of the p-phenylenediamine derivatives are p-amino-N-ethyl-N-β-(methanesulfoamidoethyl)-m-toluidine sesquisulfate monohydrate, diethylamino-p-phenylenediamine sesquisulfite, p-amino-N,N-diethyl-m-toluidine hydrochloride, p-amino-N-ethyl-N-β-hydroxyethylaniline sesquisulfate monohydrate, etc.

For processing the color photographic material of this invention, any of the development steps usually employed for processing color photographic negative materials, cinecolor photographic negative and positive films, color papers, and instant color photographic materials can be used. For instance, for processing the color photographic materials of this invention the color development processes as described in the specifications of Japanese Patent Publication No. 35,749/1970, U.S. Pat. No. 3,695,883 and U.S. patent application Ser. Nos. 234,163, filed Mar. 13, 1972 and 240,287, filed Mar. 31, 1972, and German Patent Application (OLS) No. 2,238,051 as well as in H. Gordon, *The British Journal of Photography,* pages 558– , Nov. 15, 1954, ibid., pages 440– , Sept. 9, 1955, and ibid,. pages 2– , Jan. 6, 1956; in S. Horwitz, ibid., pages 212– , Apr. 22, 1960; in E. Gehret, ibid., pages 122– , Mar. 4, 1960 and ibid., pages 396– , May 7, 1965; and in J. Meech, ibid., pages 182– , Apr. 3, 1959.

The invention will be explained in greater detail by reference to the following examples but it should be understood that the invention is not to be interpreted as being limited to these examples. Also, applications of the techniques of this invention will be further understood from these examples. Unless otherwise indicated, all parts, percents, ratios and the like are by weight.

EXAMPLE 1

Sample A was prepared by coating the following silver halide emulsion layer and a gelatino protective layer on a transparent cellulose acetate support. The compositions of the coating compositions for the layers and the manner of preparing the coating compositions were as follows:

Coating Composition for the Silver Halide Emulsion Layer:

72 g (0.107 mol) of Coupler A and 28 g (0.035 mol) of Colored Coupler B were dissolved in a mixture of 100 ml of tricresyl phospahte and 200 ml of ethyl acetate and the solution was dispersed by emulsification in 1 kg of a 10% aqueous gelatin solution using 4 g of sodium nonylbenzenesulfonate to provide Emulsion I. 330 g of Emulsion I thus prepared was added with stirring to 1 kg of a silver iodobromide emulsion (silver content 0.6 mol and iodine content 6 mol%) prepared in an ordinary manner and then an aqueous solution of 2 g of 2,4-dichloro-6-hydroxy-s-triazine sodium was added to the mixture to provide the coating composition for the silver halide emulsion layer.

Coating Composition for the Protective Layer:

The coating composition was prepared by adding 0.2 g of sodium nonylbenzenesulfonate to 1 kg of a 10% aqueous gelatin solution.

The couplers used above were as follows:

Coupler A: 1-(2,4,6-trichlorophenyl)-3-{3-[α-(2,4-di-tert-amylphenoxy)acetamido]benzamido}-5-pyrazolone Colored Copuler B: 1-(2,4,6-trichlorophenyl)-3-{3-[α-(2,4-di-tert-amylphenoxy)acetamido]benzamido}-4-(4-methoxyphenyl)azo-5-pyrazolone Similarly, Emulsions II, III, IV, V, and VI were prepared in the same way as in the case of preparing Emulsion I of Sample A except that other couplers as shown below were employed and Samples B, C, D, E and F were prepared in the same way as Sample A using Emulsions II, III, IV, V and VI respectively. The compositions of the emulsions used above were as follows:

Emulsion II (for Sample B):
- Coupler A: 84 g (0.125 mol)
- Colored Coupler C: 16 g (0.021 mol)

Emulsion III (for Sample C):
- Coupler A: 82 g (0.122 mol)
- Colored Coupler D: 18 g (0.022 mol)

Emulsion IV (for Sample D):
- Coupler A: 84 g (0.125 mol)
- Colored Coupler E: 16 g (0.022 mol)

Emulsion V (for Sample E):
- Coupler A: 84 g (0.125 mol)
- Coupler 4 of this invention: 16 g (0.022 mol)

Emulsion VI (for Sample F):
- Coupler A: 84 g (0.125 mol)
- Coupler 6 of this invention: 16.5 g (0.022 mol)

The couplers used for preparing Samples B, C and D were as follows:

Colored Coupler C: 1-(2,4,6-trichlorophenyl)-3[(2-chloro-5-tetradecylamino)anilino]-4-[(4-methoxyphenyl)azo]-5-pyrazolone Colored Coupler D: 1-(2,4,6-trichlorophenyl)-3-{{2-chloro-4-{α-[(3-t-butyl-4-hydroxy)phenoxy]tetradecylamino}-anilino}}-4-(α-(naphthyl)azo]-5-pyrazolone Colored Coupler E: 1-(2,4,6-trichlorophenyl)-3-[(2-chloro-5-tetradecylamino)anilino]-4-[(2-hydroxyphenyl)azo]-5-pyrazolone Each of Samples A to F was exposed through an optical step wedge and processed using the following development steps at 38° C.

| | | |
|---|---|---|
| 1. | Color Development | 3 minutes |

-continued

| | | |
|---|---|---|
| 2. | Bleach | 6 minutes |
| 3. | Wash | 3 minutes |
| 4. | Fix | 6 minutes |
| 5. | Wash | 3 minutes |
| 6. | Stabilization | 3 minutes |

The compositions of the processing solutions used in the above processing steps were as follows:

| | | |
|---|---|---|
| 1. | Color Developer: | |
| | Sodium Sulfite | 4 g |
| | Sodium Carbonate | 30 g |
| | Potassium Bromide | 1.5 g |
| | Hydroxyamine Sulfate | 2 g |
| | 4-(N-Ethyl-N-β-hydroxyethylamino)-2-methylaniline sulfate | 4 g |
| | Water added to make | 1 l |
| 2. | Bleach Solution: | |
| | Ammonium Bromide | 160 g |
| | Ethylenediamine Tetraacetic Acid Ammonium Iron Salt | 100 g |
| | Water added to make | 1 l |
| 3. | Fix Solution: | |
| | Sodium Sulfite | 4 g |
| | Ammonium Thiosulfate (70%) | 170 ml |
| | Water added to make | 1 l |
| 4. | Stabilization Solution: | |
| | Formalin (40%) | 10 ml |
| | Water added to make | 1 l |

Figure 2:
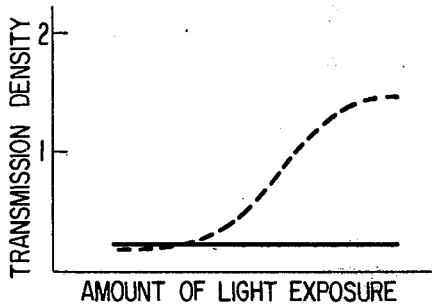
Figure 3:
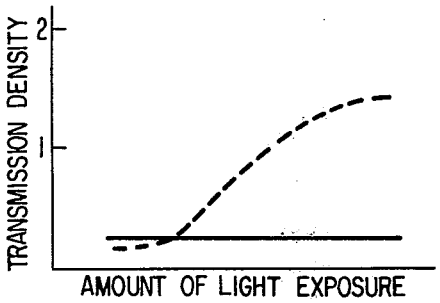
Figure 4:
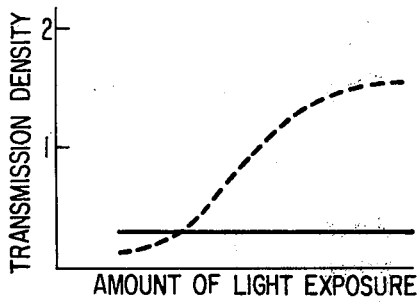
Figure 5:
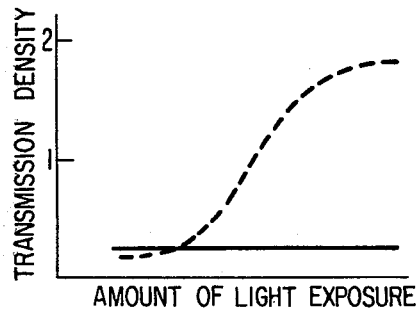

The green light transmission density and the blue light transmission density of Samples A to F thus processed were measured, the results obtained for Samples A to F are shown in FIGS. 1–6, respectively, of the accompanying drawings. From the results, it can be understood that in each case the green transmission density (dotted line) increased with the increase of the exposure amount and the blue transmission density (solid line) is constant regardless of the exposure amount, which showed that good masking effects were obtained. From the fact that Sample A contained 25 mol percent colored coupler, while the other samples contained 15 mol percent of each colored coupler, it can be understood that a more sufficient masking effect was obtained in the case of using the 3-anilino-5-pyrazolone type colored Couplers C, D, and E and Colored Couplers 4 and 6 of this invention is smaller amounts that the case of using the 3-acylamino-5-pyrazolone type colored Coupler B in a larger amount. Also, on comparing Samples A to D with Samples E and F with respect to green density, it can be understood that Samples E and F provided a larger gamma as compared with the other samples and hence the colored couplers of this invention showed higher development activity than those of other colored couplers having similar chemical structures to those of the coupler of this invention.

EXAMPLE 2

Sample G was prepared by coating a mixture of 1 kg of a 5% aqueous gelatin solution and 330 g of Emulsion I as described in Example 1 on a transparent cellulose triacetate support.

Samples H, I and J were prepared in the same way as in the case of preparing Sample G using Emulsion VII and Emulsions III, V as described in Example 1 instead of Emulsion I. The composition of Emulsion VII used above was as follows:

Coupler A: 89 g

Colored Coupler F: 11 g

Colored Coupler F: 1-(2,4,6-trichlorophenyl)-3-[(4-tetradecylamino)anilino]-4-(4-methoxyphenyl)azo-5-pyrazolone The absorption spectra of Samples G to V were measured using an EPS-3T type self recording spectrophotometer made by Hitachi, Ltd., with the cellulose triacetate used as the support being set as the standard. The absorption spectra of each sample are shown in FIG. 7 of the accompanying drawings. In FIG. 7 curves 1, 2, 3, and 4 show the absorption spectra of Samples G, H, I and J, respectively. As is clear from the results shown in FIG. 7 Sample J containing colored Coupler 4 of this invention gave a higher maximum absorbance and a absorption spectra having less trail in the long wave length side.

EXAMPLE 3

A multi-layer type Color Photographic Film K having the layer structure as shown in FIG. 8 of the accompanying drawings was prepared by coating the following layers on the support as in Example 1.

First Layer: Antihalation Layer:
A gelatin layer containing black colloidal silver.

Second Layer: Intermediate Layer:
A gelatin layer containing an emulsified dispersion of 2,5-di-t-octylhydroquinone.

Third Layer: Red-Sensitive Emulsion Layer:
Silver iodobromide emulsion (containing 7 mol percent iodine) coated amount of silver 1.6 g/m$^2$ Sensitizing Dye I: $3\times10^{-5}$ mol per mol of silver
Sensitizing Dye II: $1.2\times10^{-5}$ mol per mol of silver
Coupler G: 0.1 mol per mol of silver Fourth Layer: Intermediate Layer:
Same as the second layer.

Fifth Layer: Green-Sensitive Emulsion Layer:
Silver iodobromide emulsion containing 6 mol% iodine coated amount of silver 1.8 g/m$^2$
Sensitizing Dye III: $2.5\times10^{-5}$ mol per mol of silver
Sensitizing Dye IV: $0.8\times10^{-5}$ mol per mol of silver
Coupler A (Example 1): $3.5\times10^{-2}$ mol per mol of silver
Colored Coupler H: $1.5\times10^{-2}$ mol per mol of silver Sixth Layer: Yellow Filter Layer:
A gelatin layer containing an emulsified dispersion of yellow colloidal silver and 2,5-di-t-octylhydroquinone Seventh Layer: Blue-Sensitive Emulsion Layer:
Silver iodobromide emulsion containing 6 mol% bromine coated amount of silver 2.3 g/m$^2$
Coupler I: 0.1 mol per mol of silver Eighth Layer: Protective Layer:
A gelatin layer Also each layer contained 0.016 g of the sodium salt of 2,4-dichloro-6-hydroxy-s-triazine per g. of gelatin contained in the layer.

The materials used for preparing Sample K were as follows:

Coupler G: 1-hydroxy-N-[γ-(2,4-di-t-amylphenoxy)-butyl]-2-naphthamide

Colored Coupler H: 1-(2,4,6-trichlorophenyl)-3-{3-[α-(2,4-di-t-amylphenoxy)acetamido]benzamido}-4-methoxyphenyl) azo-5-pyrazolone Coupler I: α-(4-methoxybenzoyl)-2-chloro-5-[α-(2,5-di-t-amylphenoxy)butylamido]acetanilide Sensitizing Dye I: anhydro-5,5'-dichloro-3,3'-disulfopropyl-9-ethyl-thiacarbocyaninehydroxide pyridinium salt Sensitizing Dye II: anhydro-9-ethyl-3,3'-di-(3-sulfopropyl)-4,5,4',5'-di-benzothiacarbocyanine hydroxide triethylamine salt Sensitizing Dye III: anhydro-9'-ethyl-5,5'-dichloro-3,3'-disulfopropyloxacarbocyanine sodium salt Sensitizing Dye IV: anhydro-5,6,5',6'-tetrachloro-1,1'-diethyl-3,3'-disulfopropoxyethyoxyethylimidazolocarbocyanine hydroxide sodium salt Furthermore, Sample L was prepared in the same way as described above except that the fifth layer of sample K was replaced by the following layer:

Coupler A: $4.25\times10^{-2}$ mol per mol of silver

Colored Coupler 6 of this invention: $0.75\times10^{-2}$ mol per mol of silver

A 35 mm color negative film was prepared from each of Samples K and L thus prepared, photographed in a still camera, and subjected to the following color processing at 24° C.

| Processing Step | Time |
|---|---|
| Color Development | 12 minutes |
| Stop | 4 minutes |
| Hardening | 4 minutes |
| Wash | 4 minutes |
| Bleach | 6 minutes |
| Wash | 4 minutes |
| Fix | 8 minutes |
| Wash | 8 minutes |
| Drying | 8 minutes |

The compositions of the processing solutions used in the above processings were as follows:

| | |
|---|---|
| Color Developer: | |
| Benzyl Alcohol | 5 ml |
| Sodium Hydroxide | 0.5 g |
| Diethylene Glycol | 3 ml |
| Sodium Hexametaphosphate | 2 g |
| Sodium Sulfite | 2 g |
| Potassium Bromide | 2 g |
| 4-Amino-3-methyl-N-ethyl-N-(β-hydroxyethyl)aniline Monosulfate | 5 g |
| Metaboric Acid | 0.5 g |
| Sodium Metaborate (tetrahydrate) | 77 g |
| Water added to make | 1 l |
| Stop Solution: | |
| Sodium Acetate | 30 g |
| Glacial Acetic Acid | 8 ml |
| Water added to make | 1 l |
| Hardening Solution: | |
| Sodium Hexametaphosphate | 1 g |
| Borax (pentahydrate) | 20 g |
| Formalin (37%) | 10 ml |
| Water added to make | 1 l |
| Bleach Solution: | |
| Potassium Ferrocyanide | 8 g |
| Potassium Ferricyanide | 30 g |
| Potassium Bromide | 20 g |
| Borax (pentahydrate) | 15 g |
| Ethylenediamine Tetraacetic Acid Disodium Salt (dihydrate) | 1 g |
| Water added to make | 1 l |
| Fix Solution: | |
| Sodium Hexametaphosphate | 1 g |
| Sodium Sulfite | 5 g |
| Sodium Thiosulfate | 150 g |
| Acetic Acid | 8 ml |
| Water added to make | 1 l |

The results obtained showed that Sample L containing the colored coupler of this invention gave a color negative film having higher sensitivity and better color purity than the color negative film prepared from comparison Sample K.

EXAMPLE 4

A multilayer color photographic material M having the layer structure as shown in FIG. 9 of the accompanying drawings was prepared by coating the following layers according to the manner as described in Example 3.

First Layer: Antihalation Layer:
Same as the first layer of Sample K.

Second Layer: Intermediate Layer:
Same as the second layer of Sample K.

Third Layer: Red-Sensitive Emulsion Layer:
The silver halide emulsion and the sensitizing dye were same as in the third layer of Sample J.
Coupler J: 0.15 mol per mol of silver Fourth Layer: Intermediate Layer:
A gelatin layer containing an emulsified dispersion of 2-t-octylthio-5-(1-phenyltetrazolylthio)-hydroquinone Fifth Layer: First Green-Sensitive Emulsion Layer:
Silver iodobromide emulsion containing 8 mol% iodine coated amount of silver 1.5 g/m²
Sensitizing Dye III (Example 3): $3\times10^{-5}$ mol per mol of silver
Sensitizing Dye IV (Example 3): $1\times10^{-5}$ mol per mol of silver
Coupler K: 0.05 mol per mol of silver
Coupler L: 0.02 mol per mol of silver
2-t-Octylthio-5-(1-phenyltetrazolythio)hydroquinone: 0.006 mol per mol of silver Sixth Layer: Second Green-Sensitive Emulsion Layer:
Silver iodobromide emulsion containing 6 mol% iodine coated amount of silver 1.5 g/m²
Sensitizing Dye III: $2.5\times10^{-5}$ mol per mol of silver
Sensitizing Dye IV: $0.8\times10^{-5}$ mol per mol of silver
Coupler A: 0.004 mol per mol of silver
Colored Coupler 6 of this invention: 0.013 mol per mol of silver
2-t-Octylthio-5-(1-phenyltetrazolylthio)hydroquinone: 0.0005 mol per mol of silver Seventh Layer: Yellow Filter Layer:
Same as the sixth layer of Sample K.

Eighth Layer: First Blue-Sensitive Emulsion Layer:
Silver iodobromide emulsion layer containing 7 mol% iodine coated amount of silver 1 g/m²
Coupler M: 0.25 mol per mol of silver Ninth Layer: Second Blue-Sensitive Emulsion Layer:
Silver iodobromide emulsion containing 6 mol% iodine coated amount of silver 1.1 g/m²
Coupler M: 0.07 mol per mol of silver Tenth Layer: Protective Layer:
A gelatin layer containing polymethyl methacrylate particles having a diameter of about 1.5 microns.

Also each layer contained 0.016 g of the sodium salt of 2,4-dichloro-6-hydroxy-s-triazine per g. of gelatin contained in the layer.

The materials used for making Sample L were as follows:

Coupler J: 1-hydroxy-4-iodo-N-dodecyl-2-naphthamide

Coupler K: 1-(2,4,6-trichlorophenyl)-3-(2-chloro-5-tetradecylamido)anilino-5-pyrazolone Coupler L: 1-[4-{α-(2,4-di-t-amylphenoxy)-butylamido}phenyl]-3-methyl-4-(5-bromo-1-benztriazolyl)-5-pyrazolone Coupler M: α-(2,4-di-oxo-5,5-dimethyl-oxazolidinyl)-α-pivaloyl-2-chloro-5-{α-(2,4-di-t-amylphenoxy)-butylamido} acetanilide A 16 mm color negative film was prepared from Sample M thus obtained, photographed in a still camera, and subjected to the color processings as described in Example 1 to provide a color negative.

The color negative obtained from Sample M showed quite improved color purity, granularity, and sharpness.

When the same procedure as described in Example 4 was conducted using each of the colored Couplers 1 to 24 of this invention indicated above instead of colored Coupler 6 in the sixth layer of Sample M, almost the same results were obtained. This was true when the colored couplers were used individually or as a mixture of couplers.

Also, when the same procedure as described in Example 4 was conducted while replacing Coupler K of the fifth layer and Coupler A of the sixth layer of Sample M with the couplers as described in the specifications of U.S. Pat. Nos. 3,127,269 and 3,684,514 and U.S. patent application Ser. Nos. 415,864, filed Nov. 13, 1973 and 415,853, filed Nov. 14, 1973, for instance, the following couplers, almost the same results as in Example 4 were obtained.

Coupler N: 1-(2,4,6-trichlorophenyl)-3-[(3-tridecanoylamino-6-chloro)anilino]-5-pyrazolone Coupler O: 1-(2,4,6-trichlorophenyl)-3{3-[α-(3-pentadecylphenoxy)acetamido]benzamido}-5-pyrazolone Moreover, when the same procedure as in Example 4 was conducted while replacing Coupler L in the fifth layer of Sample M with the couplers as described in the specification of U.S. patent application Ser. No. 454,525, filed Mar. 25, 1974, corresponding to Japanese Patent Application No. 33,238/1973, such as, for instance, the following couplers, almost the same results as in Example 4 were obtained.

Coupler P: 1-(4-aminophenyl)-3-methyl-4-(5-bromo-1-benztriazolyl)-5-pyrazolone

Coupler Q: 1-[4-{3-n-pentadecylphenoxy)acetamido}-phenyl]-3-pyrolidino-4-(1-benztriazolyl)-5-pyrazolone Also, when the same procedure as described in Example 4 was conducted while replacing Coupler F in the eighth and ninth layers of Sample M with the couplers as described in U.S. patent application Ser. No. 235,937, filed Mar. 20, 1972, and 319,806, filed Dec. 29, 1972, such as, for instance, the following couplers, almost the same results as above were obtained.

Coupler R: α-(4-carboxyphenoxy)-α-pivaloyl-2-chloro-5{α-(2,4-di-t-amylphenoxy)butylamido}acetanilide Coupler S: α-{3-(1-benzyl-2,4-dioxo))hydantoin}-α-pivaloyl-2-chloro-5-{α-(2,4-di-t-amylphenoxy)-butylamido}acetoanilide Furthermore, when the hydroquinone derivative used in Sample M was replaced with the compounds described in the specifications of U.S. Pat. Nos. 3,043,690 and 3,379,529, the same "color correction effect" could be obtained. That is to say, by using the aforesaid compounds together with the colored couplers of this invention, the color correction effect, antifogging effect, and the effect of improving the fastness of the color images could be obtained.

While the invention has been described in detail and with reference to specific embodiments thereof, it will be apparent to one skilled in the art that various changes and modifications can be made therein without departing from the spirit and scope thereof.

What is claimed is:

1. A color photographic material comprising a support having thereon at least one silver halide emulsion layer containing a colored coupler represented by the general formula (I)

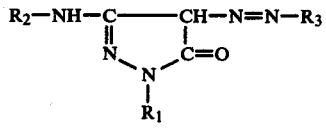

wherein $R_1$ represents a phenyl group or a 5- or 6-membered heterocyclic ring selected from the group consisting of a 2-thiazolyl ring, a 2-benzothiazolyl ring, a 2-benzoxazolyl ring, a 2-oxazolyl ring, a 2-imidazolyl ring, and a 2-benzimidazolyl ring; $R_2$ represents a phenyl group having a halogen atom, an alkoxy group, or an aryloxy group at the ortho-position to the imino group bonded to the 3-position of the pyrazolone ring, and $R_3$ represents a phenyl group having a hydroxyl group at the para-position to the azo group and at least one alkyl group having 1 to 8 carbon atoms at one of the meta-positions to the azo group of the pyrazolone ring, said coupler molecule having a hydrophobic diffusion resisting group in the molecule.

2. The color photographic material as set forth in claim 1, in which said colored coupler is represented by the general formua (II)

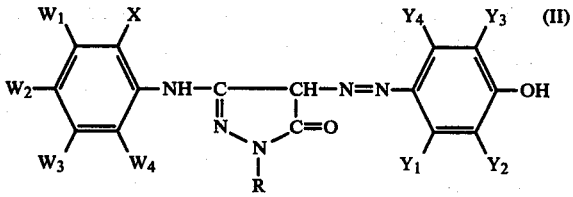

wherein R is the same as $R_1$; X represents a halogen atom, an alkoxy group, or an aryloxy group; $W_1$, $W_2$, $W_3$ and $W_4$ each represents a hydrogen atom, an alkyl group, an aryl group, an alkoxy group, an aryloxy group, an alkylthio group, an arylthio group, an amino group, an amido group, a sulfamoyl group, a carbamoyl group, an alkoxy-carbonyl group, a halogen atom, a hydroxyl group, a cyano group, or a nitro group; and $Y_1$ and $Y_4$ each represents a hydrogen atom, $Y_2$ represents a hydrogen atom or an alkyl group having 1 to 8 carbon atoms, and $Y_3$ represents an alkyl group having 1 to 8 carbon atoms; said coupler molecule having in the molecule at least one hydrophobic group capable of making the coupler diffusion resistant, said hydrophobic group having more than 8 carbon atoms.

3. The color photographic material as set forth in claim 1, in which group R of the general formula (II) is a phenyl group represented by the following formula

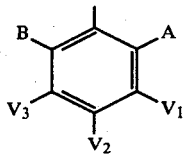

wherein A and B each represents a hydrogen atom, a halogen atom, an alkyl group, an alkoxy group, an alkylthio group, an aryl group, an aryloxy group, an arylthio group, or a cyano group, said A and B not being simultaneously a hydrogen atom; and $V_1$, $V_2$, and $V_3$ each represents a hydrogen atom, a halogen atom, an alkyl group, an alkoxy group, an alkylthio group, an aryl group, an aryloxy group, an arylthio group, a cyano group, an acylamino group, a carbamyl group, a ureido group, a sulfonamido group, a sulfamyl group, an alkylsulfonyl group, an arylsulfonyl group, an alkylcarbonyl group, an arylcarbonyl group, or an alkoxycarbonyl group.

4. The color photographic material as set forth in claim 1, in which said colored coupler is represented by the general formula (III)

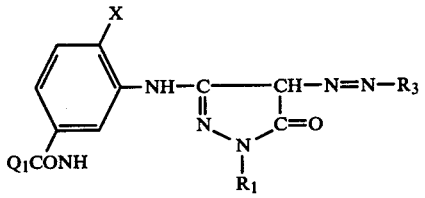

(III)

wherein $R_1$ and $R_3$ have the same significance as in the general formula (I) of claim 1; X represents a halogen atom or an alkoxy group; and $Q_1$ represents an alkyl group having 7 to 23 carbon atoms.

5. The color photographic material as set forth in claim 1, in which said colored coupler is represented by the general formula (IV)

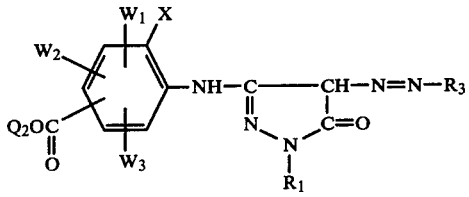

(IV)

wherein $R_1$ and $R_3$ have the same significance as in the general formula (I) of claim 1; wherein X represents a halogen atom, an alkoxy group, or an aryloxy group; $W_1$, $W_2$, and $W_3$ each represents a hydrogen atom, an alkyl group, an aryl group, an alkoxy group, an aryloxy group, an alkylthio group, an arylthio group, an amino group, an amido group, a sulfamoyl group, a carbamoyl group, an alkoxycarbonyl group, a halogen atom, a hydroxyl group, a cyano group, or a nitro group, and $Q_2$ represents an alkyl group having 8 to 26 carbon atoms or an alkyl group substituted with an alkoxy group, an aryloxy group, an acyloxy group, an alkoxycarbonyl group, an acylamino group, or a carbamoyl group.

6. The color photographic material as set forth in claim 1, in which said colored coupler is represented by the general formula (V)

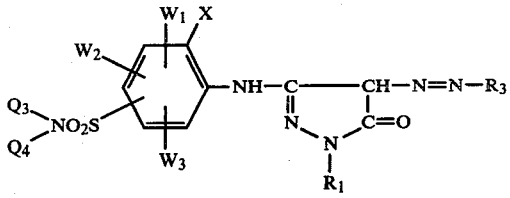

(V)

wherein $R_1$ and $R_3$ have the same significance as in the general formula (I) of claim 1; wherein X represents a halogen atom, an alkoxy group, or an aryloxy group; $W_1$, $W_2$ and $W_3$ each represents a hydrogen atom, an alkyl group, an aryl group, an alkoxy group, an aryloxy group, an alkylthio group, an arylthio group, an amino group, an amido group, a sulfamoyl group, a carbamoyl group, an alkoxycarbonyl group, a halogen atom, a hydroxyl group, a cyano group, or a nitro group; and $Q_3$ and $Q_4$ each represents an alkyl group having 8 to 26 carbon atoms or an alkyl group substituted with an alkoxy group, an aryloxy group, an acyloxy group, an alkoxycarbonyl group, an acylamino group, or a carbamoyl group; and one of said $Q_3$ and $Q_4$ may be a hydrogen atom.

7. The color photographic material as set forth in claim 1 wherein said colored coupler represented by the general formula (I) is 1-(2,4,6-Trichlorophenyl)-3-(2-chloro-5-tetradecanoylamino-anilino)-4-(3-methyl-4-hydroxyphenylazo)-2-pyrazoline-5-one.

8. The color photographic material as set forth in claim 1 wherein said colored coupler represented by the general formula (I) is 1-(2,4,6-Trichlorophenyl)-3-(2-chloro5-tetradecylamino-anilino)-4-(3-tert-butyl-4-hydroxyphenylazo)-2-pyrazoline-5-one.

9. A multilayer color photographic material comprising a support having therein at least one red-sensitive silver halide emulsion layer containing a phenol derivative or an α-naphthol derivative capable of forming a cyan dye by coupling with the oxidation product of an aromatic primary amine developing agent, at least one green-sensitive silver halide emulsion layer containing a 5-pyrazolone derivative forming a magenta dye and the colored coupler represented by general formula (I) in claim 1, and at least one blue-sensitive emulsion layer containing an open chain-type ketomethylene compound forming a yellow dye.

10. The color photographic material as set forth in claim 1, wherein $R_1$ is a phenyl group selected from the class consisting of phenyl, 2-chlorophenyl, 4-chlorophenyl, 2,5-dichlorophenyl, 2,6-dichlorophenyl, 2,4,6-trichlorophenyl, 2-bromophenyl, 3,5-dibromophenyl, 2-cyanophenyl, 4-cyanophenyl, 3-nitrophenyl, 4-nitrophenyl, 4-tolyl, 2,6-dimethylphenyl, 2,6-diethylphenyl, 4-butylphenyl, 2-trifluoromethylphenyl, 2-ethoxyphenyl, 4-phenylphenyl, 4-phenoxyphenyl, N-methylbenzamidophenyl, N,N-diphenylcarbamylphenyl, N,N-diphenylsufamylphenyl, N,N-dibutylsulfamylphenyl, phenyl-N-methyl-sulfonamidophenyl, 2-methyl-5-nitrophenyl, 2-chloro-5-cyanophenyl, 5-chloro-2-methylphenyl, 2,6-dichloro-4-methylphenyl, 2,4-dichloro-6-methylphenyl, 2-chloro-4,6-dimethylphenyl, 2,6-dichloro-4-methoxyphenyl, 2,6-dichloro-4-nitrophenyl, 2, 4, 6-trimethyl-3-nitrophenyl, 2, 4, 6-trimethyl-3-substituted aminophenyl, 2, 6-dichloro-4-acetylphenyl, 4-hexadecylcarbonyloxyphenyl and 2, 6-dichloro-4-amylthiophenyl.

11. The color photographic material as set forth in claim 1, wherein said colored coupler represented by the general formula (I) is Coupler (3):

1-(2,4,6-Trichlorophenyl)-3-{(2-chloro-5-[β-(2,4-di-tert-amylphenoxy) ethoxycarbonyl]anilino}-4-(3-tert-butyl-4-hydroxyphenylazo)-2-pyrazoline-5-one, Coupler (5):

1-(2,4,6-Dichloro-4-methoxyphenyl)-3-(2-chloro-4-n-dodecanoylaminoalino)-4-(3-sec-butyl-4-hydroxy-phenylazo)-2-pyrazoline-5-one, Coupler (6):

1-(2,4,6-Trichlorophenyl)-3-(2-chloro-5tet-radecanoylaminoalino)-4-(3-methyl-4-hydroxy-phenylazo)-2-pyrazoline-5 -one, Coupler (9):

1-{4-[α-(4-Di-tert-amylphenoxy)butylamido]-phenyl}-3-2,4-dichloroanilino)-4-(3-n-octyl-4hy-droxyphenylazo)-2-pyrazoline-5-one, Coupler (10):

1-(2,5-Dichlorophenyl)-3-(2-n-dodecyloxyanilino)-4-(3-tert-butyl-4-hydroxyphenylazo)-2-pyrazoline-5-one, Coupler (11):

1-(2,4,6Trichlorophenyl-3-(2chloro-4-n-tetradecyl-sulfamoylanilino)-4-(3ethyl-4-hydroxyphenylazo)-2-pyrazoline-5-one, Coupler (14):

1-(2,6-Dichloro-4-methylphenyl)-3-[2-chloro-5-{β-(3-tert-butyl-4-hydroxyphenoxy)tetradecyloxycar-bonyl}anilino]-4-(3-methyl-4-hydroxyphenylazo)-2-pyrazoline-5-one, Coupler (15):

1-(2,4,6-Trichlorophenyl)-3-[2-methoxy-4-{β-(3-tert-octyl-4-hydroxyphenoxy)dodecylsulfamoyl}-anilino]-4-(3,5-dimethyl-4-hydroxyphenylazo)-2-pyrazoline-5-one, Coupler (18):

1-(2,6-Dichloro-4-methylphenyl)-3-(2-chloro-5-n-dodecyloxycarbonylmethoxycarbonylanilino)-4-(3-tert-butyl-4-hydroxyphenylazo)-2-pyrazoline-5-one, Coupler (21):

1-(2,4-Dichloro-6-methylphenyl)-3-{2-methoxy-5-(N-methyl-N-n-octodecylsufamoyl)anilino}4-(3-ethyl-4-hydroxyphenylazo)-2-pyrazoline-5-one, Coupler (22):

1-(2,4,6-Trichlorophenyl)-3-(2-dodecyloxy-5-cyclohexylsulfamoylanilino)4-4(3-n-butyl-4-hydroxyphenylazo)-2-pyrazoline-5-one, Coupler (23):

1-(2,4,6-Trichlorophenyl)-3-(2-chloro-5-n-tetradecyl-carbamoylanilino)-4-(3-methyl-4-hydroxy-phenylazo)-2-pyrazoline-5-one, Coupler (24):

1-(2,4-Dichloro-6-methylphenyl)-3-[2-methoxy-5-{γ-(2,4-di-tert-amylphenoxy)propylcarbamoyl}-anilino]-4(3-sec-butyl-4-hydroxyphenylazo-2-pyrazoline-5-one, or Coupler (25):

1-(2,4,6-Trichlorophenyl)-3-(2-chloro-5-tetradecyl-aminoalino-4-(3-tert-butyl-4-hydroxyphenylazo)-2-pyrazoline-5-one.

* * * * *